US008102128B2

(12) United States Patent
Terashima et al.

(10) Patent No.: US 8,102,128 B2
(45) Date of Patent: Jan. 24, 2012

(54) DRIVING METHOD AND DRIVING DEVICE FOR DISCHARGE LAMP, LIGHT SOURCE DEVICE, AND IMAGE DISPLAY DEVICE

(75) Inventors: Tetsuo Terashima, Chino (JP); Kentaro Yamauchi, Ashiya (JP); Takeshi Takezawa, Matsumoto (JP); Kazuo Okawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 446 days.

(21) Appl. No.: 12/404,341

(22) Filed: Mar. 16, 2009

(65) Prior Publication Data

US 2009/0236998 A1 Sep. 24, 2009

(30) Foreign Application Priority Data

Mar. 17, 2008 (JP) ..... 2008-067109

(51) Int. Cl.
*H05B 41/36* (2006.01)

(52) U.S. Cl. ..... 315/209 R; 315/246

(58) Field of Classification Search ..... 315/209 R, 315/246, 307, 291, 287; 345/212
See application file for complete search history.

(56) References Cited

U.S. PATENT DOCUMENTS

| | | | | |
|---|---|---|---|---|
| 6,815,907 | B2 | 11/2004 | Riederer | |
| 2007/0228996 | A1 * | 10/2007 | Sugaya | 315/247 |
| 2008/0024853 | A1 * | 1/2008 | Tanaka et al. | 359/238 |

FOREIGN PATENT DOCUMENTS

| | | |
|---|---|---|
| JP | 2004-525496 T | 8/2004 |
| WO | WO-02/091806 | 11/2002 |

* cited by examiner

*Primary Examiner* — Daniel D Chang
(74) *Attorney, Agent, or Firm* — AdvantEdge Law Group, LLC

(57) ABSTRACT

A driving method for a discharge lamp that lights by performing discharge between two electrodes while alternately switching a polarity of a voltage applied between the two electrodes includes: modulating an anode duty ratio, which is a ratio of an anode time for which one of the electrodes operates as an anode in one period of the polarity switching, by setting first and second periods with different anode duty ratios; and setting a first polarity switching period in the first period to be shorter than a second polarity switching period in the second period.

14 Claims, 21 Drawing Sheets

DRIVING METHOD AND DRIVING DEVICE FOR DISCHARGE LAMP, LIGHT SOURCE DEVICE, AND IMAGE DISPLAY DEVICE

BACKGROUND

1. Technical Field

The present invention relates to a technique of driving a discharge lamp that lights by discharge between electrodes.

2. Related Art

A high-intensity discharge lamp, such as a high-pressure gas discharge lamp, is used as a light source for an image display device, such as a projector. As a method of making the high-intensity discharge lamp light, an alternating current (AC lamp current) is supplied to the high-intensity discharge lamp. Thus, in order to improve the stability of light arc occurring within a high-intensity discharge lamp when supplying an AC lamp current to make the high-intensity discharge lamp light, JP-T-2004-525496 proposes to supply to the high-intensity discharge lamp an AC lamp current which has an almost constant absolute value and of which a pulse width ratio between a pulse width of a positive pulse and a pulse width of a negative pulse is modulated.

However, even if the high-intensity discharge lamp is made to light by performing pulse width modulation of the AC lamp current, a distance between discharge electrodes increases as the discharge electrodes wear away. Then, a voltage (lamp voltage) between the discharge electrodes rises. Thus, if the lamp voltage rises, it becomes difficult to maintain projections formed at the tips of the discharge electrodes in order to stabilize the light arc. As a result, lighting of the high-intensity discharge lamp becomes difficult. This problem is not limited to the high-intensity discharge lamp but is common in various kinds of discharge lamps that emit light by arc discharge between electrodes.

SUMMARY

An advantage of some aspects of the invention is to make it possible to use a discharge lamp light for a long period of time.

According to an aspect of the invention, a driving method for a discharge lamp that lights by performing discharge between two electrodes while alternately switching a polarity of a voltage applied between the two electrodes includes: modulating an anode duty ratio, which is a ratio of an anode time for which one of the electrodes operates as an anode in one cycle of the polarity switching, by setting first and second periods with different anode duty ratios; and setting a first polarity switching period in the first period to be shorter than a second polarity switching period in the second period.

In general, when a polarity switching period is short, growth of a projection formed in a discharge electrode is accelerated. Moreover, the growth form of a projection changes with the temperature of a discharge electrode that changes with an anode duty ratio. According to the aspect of the invention, the anode duty ratio in the first period for which the polarity switching period is short and growth of a projection is accelerated is different from that in the second period. Accordingly, since the discharge electrode can have a temperature suitable for growth of a projection in the first period for which the growth of a projection is accelerated, it becomes possible to use the discharge lamp over a longer period of time.

In the driving method for a discharge lamp described above, preferably, the anode duty ratio in the first period is higher than that in the second period.

Usually, the temperature of a discharge electrode rises in proportion as the anode duty ratio increases. In this case, growth of a projection can be further accelerated by setting the temperature of the first period, for which the growth of a projection is accelerated, higher.

In the driving method for a discharge lamp described above, preferably, a third period with an anode duty ratio higher than that in the first period is set when modulating the anode duty ratio and a polarity switching period in the third period is set longer than the first polarity switching period.

In general, since the melted amount of an electrode tip increases as the polarity switching period increases, a projection formed in a discharge electrode becomes larger. In this case, the anode duty ratio is set high in the third period for which the polarity switching period is long. Therefore, since the melted amount of an electrode tip increases, a larger projection can be formed in the discharge electrode.

In the driving method for a discharge lamp described above, preferably, the first polarity switching period when a predetermined condition is satisfied is set shorter than the first polarity switching period when the predetermined condition is not satisfied.

In this case, the first polarity switching period when the predetermined condition is satisfied is shorter than that when the predetermined condition is not satisfied. Usually, growth of a projection is accelerated in proportion as a polarity switching period is short. Accordingly, by appropriately setting the predetermined condition, growth of a projection can be further accelerated in a condition which is more preferable for the growth of a projection.

In the driving method for a discharge lamp described above, preferably, the second polarity switching period when the predetermined condition is satisfied is set longer than the second polarity switching period when the predetermined condition is not satisfied.

In general, since the melted amount of an electrode tip increases as the polarity switching period increases, a projection formed in the discharge electrode can be made larger. In this case, by forming a larger projection, a discharge electrode can be made suitable for growth of a projection.

In the driving method for a discharge lamp described above, preferably, the predetermined condition is satisfied when a cumulative lighting time of the discharge lamp exceeds a predetermined reference time.

In this case, when the cumulative lighting time of the discharge lamp exceeds the reference time, the first polarity switching period is set to be shorter. Therefore, growth of a projection is accelerated for the electrode that has deteriorated due to the long cumulative lighting time, and excessive growth of a projection is suppressed for the electrode that has not deteriorated yet because the cumulative lighting time is short.

In the driving method for a discharge lamp described above, it is preferable to further include: detecting a deterioration state of the electrode according to the use of the discharge lamp; and determining whether or not the predetermined condition is satisfied on the basis of the deterioration state.

In this case, the first polarity switching period is set to be shorter on the basis of the deterioration state of the electrode. Therefore, growth of a projection is accelerated for the electrode that has deteriorated, and excessive growth of a projection is suppressed for the electrode that has not deteriorated yet.

In the driving method for a discharge lamp described above, preferably, the deterioration state is detected on the basis of a voltage applied between the two electrodes in supplying predetermined power between the two electrodes.

In general, when the electrode deteriorates, the arc length increases. As a result, a voltage applied in supplying the predetermined power rises. Therefore, according to the driving method described above, the deterioration state of the electrode can be detected more easily.

In the driving method for a discharge lamp described above, preferably, an absolute value of a discharge current supplied to the discharge lamp at a rear end of a same polarity period for which the polarity is uniformly maintained is set larger than an absolute value of an average discharge current in the same polarity period.

In this case, since the absolute value of the discharge current at the rear end of the same polarity period is set larger than the absolute value of the average discharge current, the temperature of the discharge electrode when the discharge electrode switches from an anode to a cathode rises. Usually, since a projection grows when the discharge electrode switches from the anode to the cathode, the growth of the projection can be further accelerated.

In the driving method for a discharge lamp described above, preferably, the discharge lamp has a condition in which an operating temperature of one of the two electrodes is higher than that of the other electrode, and an anode duty ratio in the one electrode is set to be lower than that in the other electrode.

In this case, the anode duty ratio in the one electrode whose operating temperature increases is set to be lower than that in the other electrode. Accordingly, the temperature of the one electrode and the temperature of the other electrode can be set to temperatures suitable for growth of a projection.

In the driving method for a discharge lamp described above, preferably, the discharge lamp has a reflecting mirror that reflects light emitted between the electrodes toward the other electrode side.

By providing the reflecting mirror, heat radiation from the electrode on a side at which the reflecting mirror is provided can be prevented. In this case, the temperature of the one electrode from which heat radiation is prevented by the reflecting mirror and the temperature of the other electrode from which heat radiation is not prevented can be set to temperatures suitable for growth of a projection.

In addition, the invention may also be realized in various forms. For example, the invention may be realized as a driving device for a discharge lamp, a light source device using a discharge lamp and a control method thereof, and an image display device using the light source device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described through examples in the following order.

A. First example
B. Second example
C. Third example
D. Fourth example
E. Modifications of driving waveform
F. Modifications

A. First Example

Figure 1:
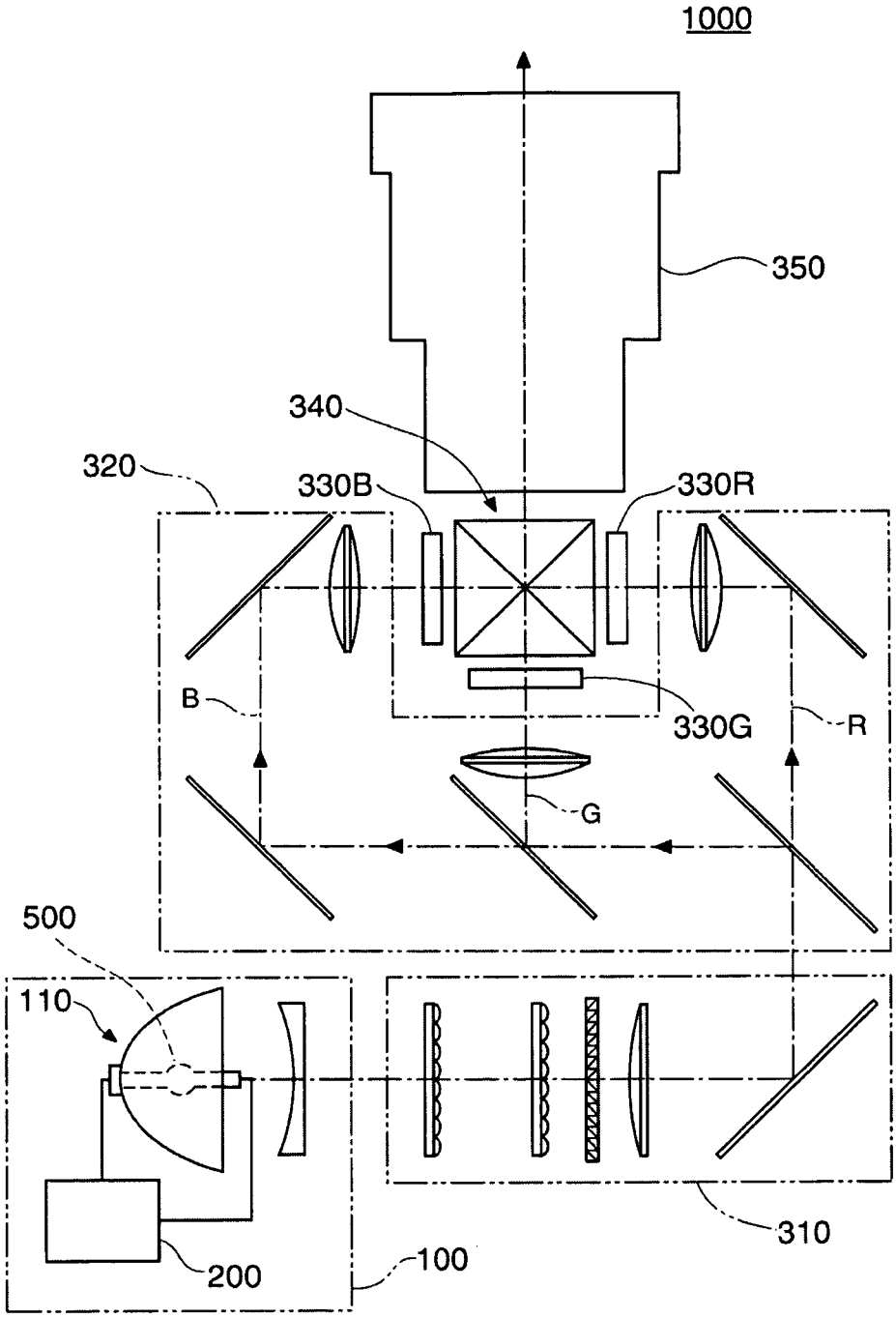
FIG. 1 is a schematic view illustrating the configuration of a projector in a first example of the invention.

FIG. 1 is a schematic view illustrating the configuration of a projector 1000 in a first example of the invention. The projector 1000 includes a light source device 100, an illumination optical system 310, a color separation optical system 320, three liquid crystal light valves 330R, 330G, and 330B, a cross dichroic prism 340, and a projection optical system 350.

The light source device 100 has a light source unit 110 to which a discharge lamp 500 is attached and a discharge lamp driving device 200 that drives the discharge lamp 500. The discharge lamp 500 receives power from the discharge lamp driving device 200 to emit light. The light source unit 110 emits discharged light of the discharge lamp 500 toward the illumination optical system 310. In addition, the specific configurations and functions of the light source unit 110 and discharge lamp driving device 200 will be described later.

The light emitted from the light source unit 110 has uniform illuminance by the illumination optical system 310, and the light emitted from the light source unit 110 is polarized in one direction by the illumination optical system 310. The light which has the uniform illuminance and is polarized in one direction through the illumination optical system 310 is separated into color light components with three colors of red (R), green (G), and blue (B) by the color separation optical system 320. The color light components with three colors separated by the color separation optical system 320 are modulated by the corresponding liquid crystal light valves 330R, 330G, and 330B, respectively. The color light components with three colors modulated by the liquid crystal light valves 330R, 330G, and 330B are mixed by the cross dichroic prism 340 to be then incident on the projection optical system 350. When the projection optical system 350 projects the incident light onto a screen (not shown), an image as a full color image in which images modulated by the liquid crystal light valves 330R, 330G, and 330B are mixed is displayed on the screen. In addition, although the color light components with the three colors are separately modulated by the three liquid crystal light valves 330R, 330G, and 330B in the first example, modulation of light may also be performed by one liquid crystal light valve provided with a color filter. In this case, the color separation optical system 320 and the cross dichroic prism 340 may be omitted.

Figure 2:
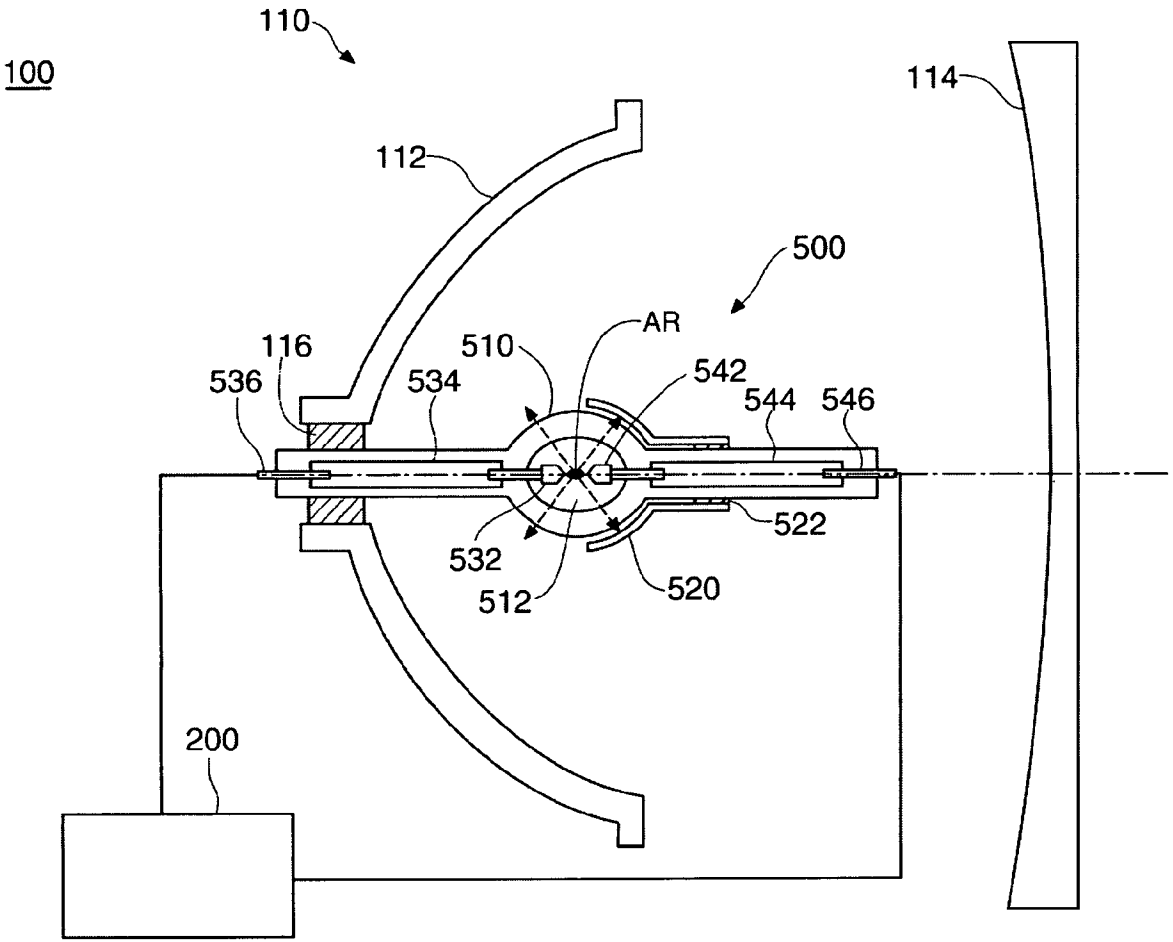
FIG. 2 is an explanatory view illustrating the configuration of a light source device.

FIG. 2 is an explanatory view illustrating the configuration of the light source device 100. The light source device 100 has the light source unit 110 and the discharge lamp driving device 200 as described above. The light source unit 110 includes the discharge lamp 500, a main reflecting mirror 112 having a spheroidal reflecting surface, and a parallelizing lens 114 that makes emitted light almost parallel light beams. However, the reflecting surface of the main reflecting mirror 112 does not necessarily need to be a spheroidal shape. For example, the reflecting surface of the main reflecting mirror 112 may have a paraboloidal shape. In this case, the parallelizing lens 114 may be omitted if a light emitting portion of the discharge lamp 500 is placed on a so-called focal point of a paraboloidal mirror. The main reflecting mirror 112 and the discharge lamp 500 are bonded to each other with an inorganic adhesive 116.

The discharge lamp 500 is formed by bonding a discharge lamp body 510 and an auxiliary reflecting mirror 520, which has a spherical reflecting surface, with an inorganic adhesive 522. The discharge lamp body 510 is formed of a glass material, such as quartz glass. Two discharge electrodes 532 and 542 formed of an electrode material using high-melting-point metal, such as tungsten, two connecting members 534 and 544, and two electrode terminals 536 and 546 are provided in the discharge lamp body 510. The discharge electrodes 532 and 542 are disposed such that tips thereof face each other in a discharge space 512 formed in the middle of the discharge lamp body 510. Rare gas or gas containing mercury or a metal halogen compound is injected as a discharge medium into the discharge space 512. The connecting member 534 is a member that electrically connects the discharge electrode 532 with the electrode terminal 536, and the connecting member 544 is a member that electrically connects the discharge electrode 542 with the electrode terminal 546.

The electrode terminals 536 and 546 of the discharge lamp 500 are connected to the discharge lamp driving device 200. The discharge lamp driving device 200 supplies a pulsed alternating current (AC pulse current) to the electrode terminals 536 and 546. When the AC pulse current is supplied to the electrode terminals 536 and 546, arc AR occurs between the tips of the two discharge electrodes 532 and 542 in the discharge space 512. The arc AR makes light emitted from the position, at which the arc AR has occurred, toward all directions. The auxiliary reflecting mirror 520 reflects light, which is emitted in a direction of one discharge electrode 542, toward the main reflecting mirror 112. The degree of parallelization of light emitted from the light source unit 110 can be further increased by reflecting the light emitted in the direction of the discharge electrode 542 toward the main reflecting mirror 112 as described above. Moreover, in the following description, the discharge electrode 542 on a side where the auxiliary reflecting mirror 520 is provided is also referred to as the 'auxiliary mirror side electrode 542', and the other discharge electrode 532 is also referred to as the 'main mirror side electrode 532'.

Figure 3:
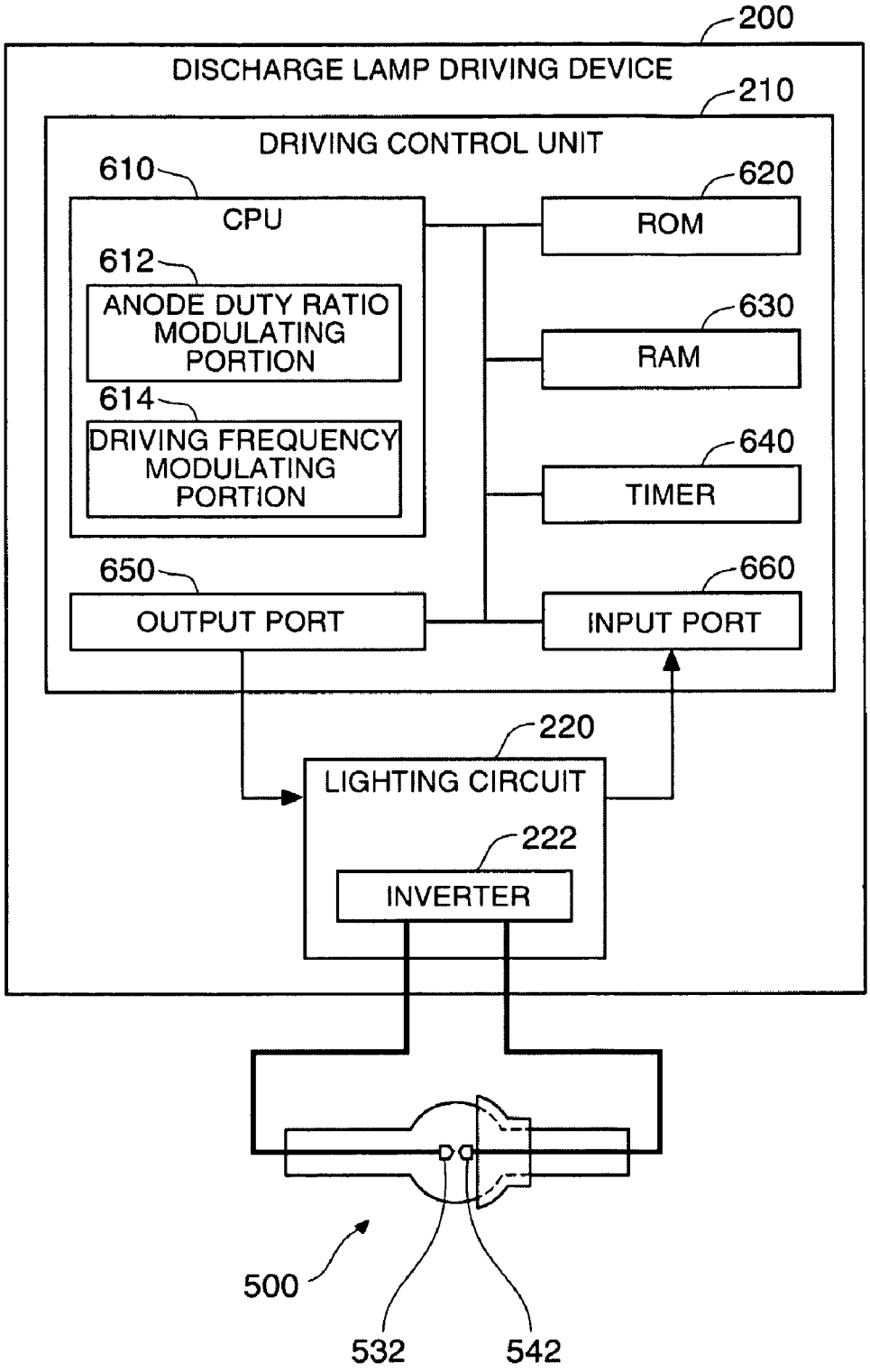
FIG. 3 is a block diagram illustrating the configuration of a discharge lamp driving device.

FIG. 3 is a block diagram illustrating the configuration of the discharge lamp driving device 200. The discharge lamp driving device 200 has a driving control unit 210 and a lighting circuit 220. The driving control unit 210 functions as a computer including a CPU 610, a ROM 620 and a RAM 630, a timer 640, an output port 650 for outputting a control signal to the lighting circuit 220, and an input port 660 for acquiring a signal from the lighting circuit 220. The CPU 610 of the driving control unit 210 executes a program stored in the ROM 620 on the basis of an output of the timer 640. Thus, the CPU 610 realizes a function of an anode duty ratio modulating unit 612 and a function of a driving frequency modulating unit 614. In addition, the functions of the anode duty ratio modulating unit 612 and driving frequency modulating unit 614 will be described later.

The lighting circuit 220 has an inverter 222 that generates an AC pulse current. The lighting circuit 220 supplies an AC pulse current with constant power (for example, 200 W) to the discharge lamp 500 by controlling the inverter 222 on the basis of a control signal supplied from the driving control unit 210 through the output port 650. Specifically, the lighting circuit 220 controls the inverter 222 to generate a rectangular AC pulse current corresponding to power supply conditions (for example, a frequency and a duty ratio of the AC pulse current) designated by the control signal in the inverter 222. The lighting circuit 220 supplies the AC pulse current generated by the inverter 222 to the discharge lamp 500.

In addition, the lighting circuit 220 is configured to detect a voltage (lamp voltage) between the discharge electrodes 532 and 542 in supplying an AC pulse current with constant power to the discharge lamp 500. In general, as the discharge lamp 500 lights, the discharge electrodes 532 and 542 wear away gradually. Then, the tips become flat. When the tips of the discharge electrodes 532 and 542 become flat, the distance between the discharge electrodes 532 and 542 increases. Then, when the discharge lamp 500 deteriorates to cause the discharge electrode 532 to wear away, the voltage (lamp voltage) between the discharge electrodes 532 and 542 required for driving the discharge lamp 500 with the constant power rises. Therefore, a deterioration state of the discharge lamp 500 can be detected by detecting the lamp voltage. When the discharge electrodes 532 and 542 wear away to make the tips flat, the arc occurs from random positions of the flat portions. As a result, when the tips of the discharge electrodes 532 and 542 become flat, so-called arc jump that the arc occurrence position moves occurs.

Figure 4:
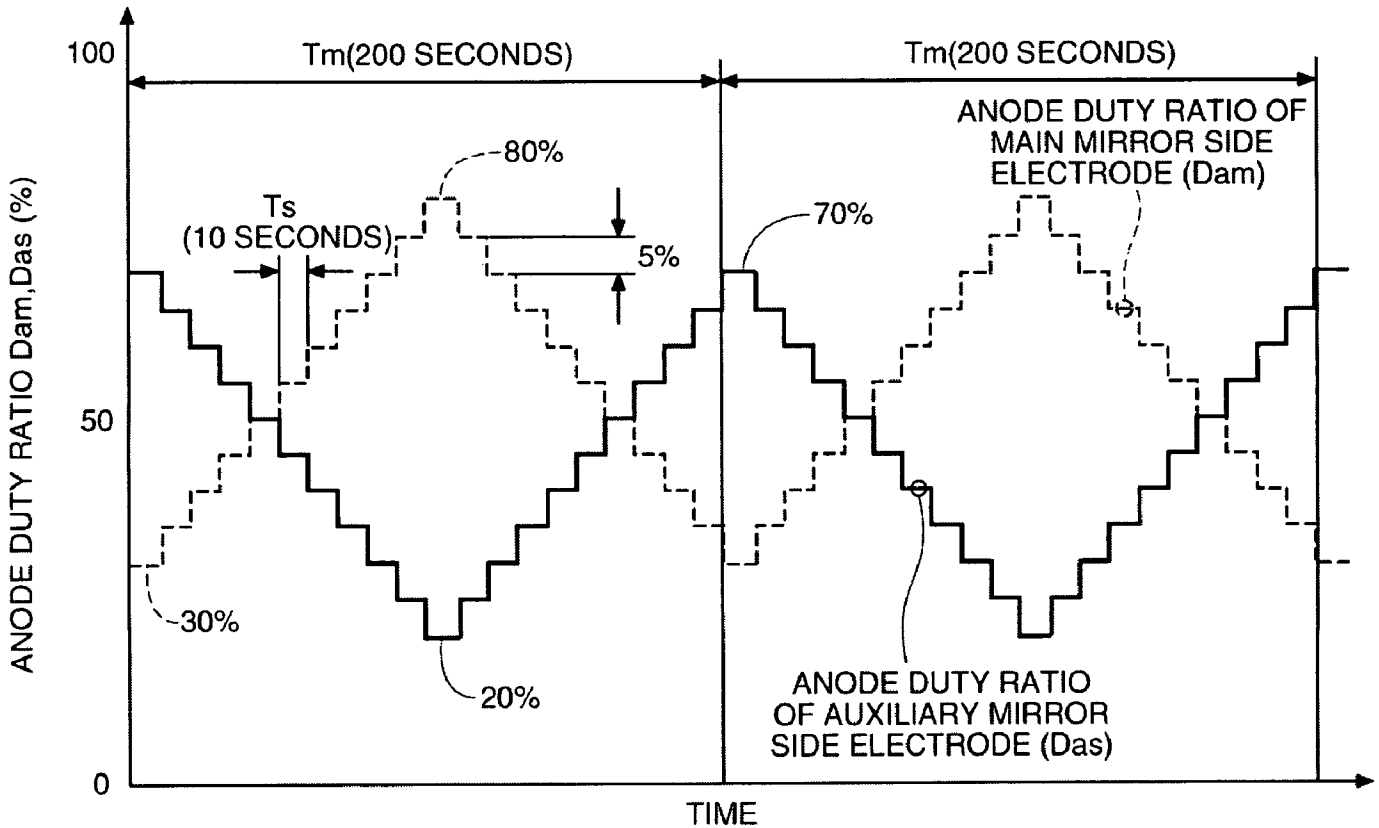
FIG. 4 is an explanatory view illustrating how a duty ratio of an AC pulse current is modulated.

The anode duty ratio modulating unit 612 of the driving control unit 210 modulates the duty ratio of the AC pulse current within a modulation period (for example, 200 seconds) set beforehand. FIG. 4 is an explanatory view illustrating how the duty ratio of the AC pulse current is modulated. The graph of FIG. 4 shows temporal changes of anode duty ratios Das and Dam. Here, the anode duty ratios Das and Dam are ratios of time (anode time), for which the auxiliary mirror side electrode 542 and the main mirror side electrode 532 operate as anodes, to one period of the AC pulse current, respectively. In the graph of FIG. 4, a solid line shows the anode duty ratio Das of the auxiliary mirror side electrode 542, and a broken line shows the anode duty ratio Dam of the main mirror side electrode 532.

In the example shown in FIG. 4, the anode duty ratio modulating unit 612 (FIG. 3) changes the anode duty ratios Das and Dam by a predetermined change width (5%) whenever a step time Ts (10 seconds) corresponding to 1/20 of a modulation period Tm (200 seconds) elapses. Then, the anode duty ratio Dam of the main mirror side electrode 532 is modulated in a range of 30% to 80% and the anode duty ratio Das of the auxiliary mirror side electrode 542 is modulated in a range of 20% to 70%. Thus, by modulating the anode duty ratios Das and Dam within the modulation period Tm, uneven deposition of an electrode material on an inner wall of the discharge space 512 (FIG. 2) can be suppressed. By suppressing the uneven deposition of the electrode material, it becomes possible to suppress abnormal discharge caused by a variation in the amount of light of the discharge lamp 500 or growth of needle-like crystal of the electrode material. Moreover, in the first example, the modulation period Tm is set to 200 seconds and the step time Ts is set to 10 seconds. In this case, the modulation period Tm and the step time Ts may be suitably changed on the basis of a characteristic, a power supply condition, and the like of the discharge lamp 500. Moreover, the change widths and modulation ranges of the anode duty ratios Das and Dam may also be suitably changed on the basis of a characteristic, a power supply condition, and the like of the discharge lamp 500.

As is apparent from FIG. 4, in the first example, a maximum value of the anode duty ratio Dam of the main mirror side electrode 532 is set to be higher than that of the anode duty ratio Das of the auxiliary mirror side electrode 542. However, the maximum values of the anode duty ratios of the two discharge electrodes 532 and 542 do not necessarily need to be different. However, when the maximum values of the anode duty ratios are increased, the highest temperatures of the discharge electrodes 532 and 542 are generally increased. On the other hand, when the discharge lamp 500 having the auxiliary reflecting mirror 520 is used as shown in FIG. 2, the heat from the auxiliary mirror side electrode 542 becomes difficult to be emitted. Therefore, it is more preferable to set the maximum value of the anode duty ratio Dam of the main mirror side electrode 532 higher than that of the anode duty ratio Das of the auxiliary mirror side electrode 542 from a point of view that an excessive temperature increase in the auxiliary mirror side electrode 542 can be suppressed. Moreover, in general, when the temperature of one of the discharge electrodes 532 and 542 becomes higher than that of the other one due to an influence of a cooling method or the like in driving the two discharge electrodes 532 and 542 in the same operating condition, it is more preferable to make the anode duty ratio of the one discharge electrode lower than that of the other one.

Furthermore, in the first example, the anode duty ratio Das of the auxiliary mirror side electrode 542 decreases for every step time Ts in the first half of the modulation period Tm and increases for every step time Ts in the second half. However, the change pattern of the anode duty ratios Das and Dam is not necessarily limited thereto. For example, the anode duty ratio Das of the auxiliary mirror side electrode 542 may be made to monotonically increase or monotonically decrease within the modulation period Tm. However, it is more preferable to make the amount of change in the anode duty ratios Das and Dam for every step time Ts constant as shown in FIG. 4 from a point of view that the thermal shock applied to the discharge lamp 500 can be reduced.

Figure 5A:
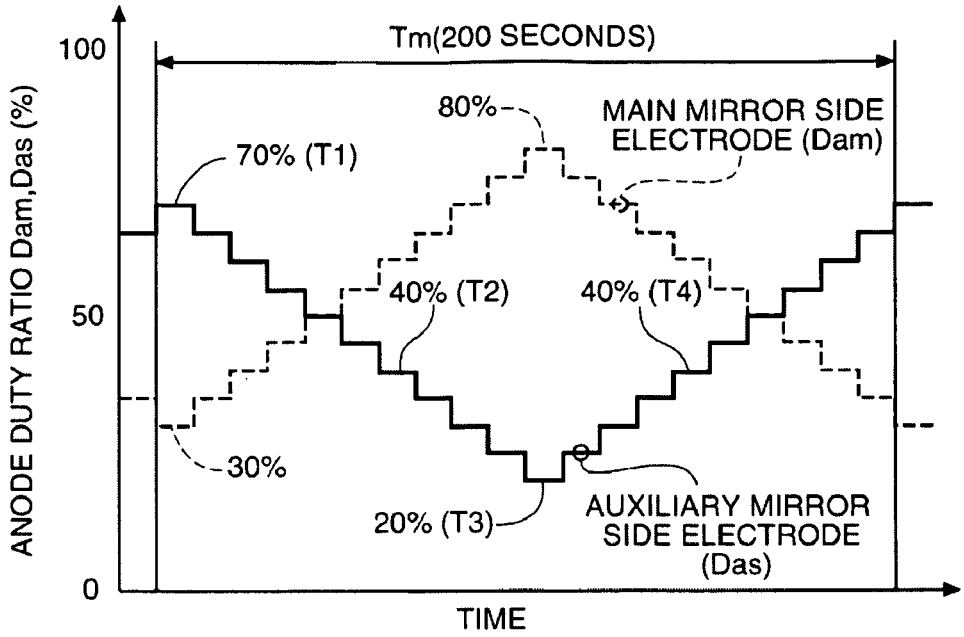
FIGS. 5A and 5B are explanatory views illustrating how a frequency of an AC pulse current is modulated.
Figure 5B:
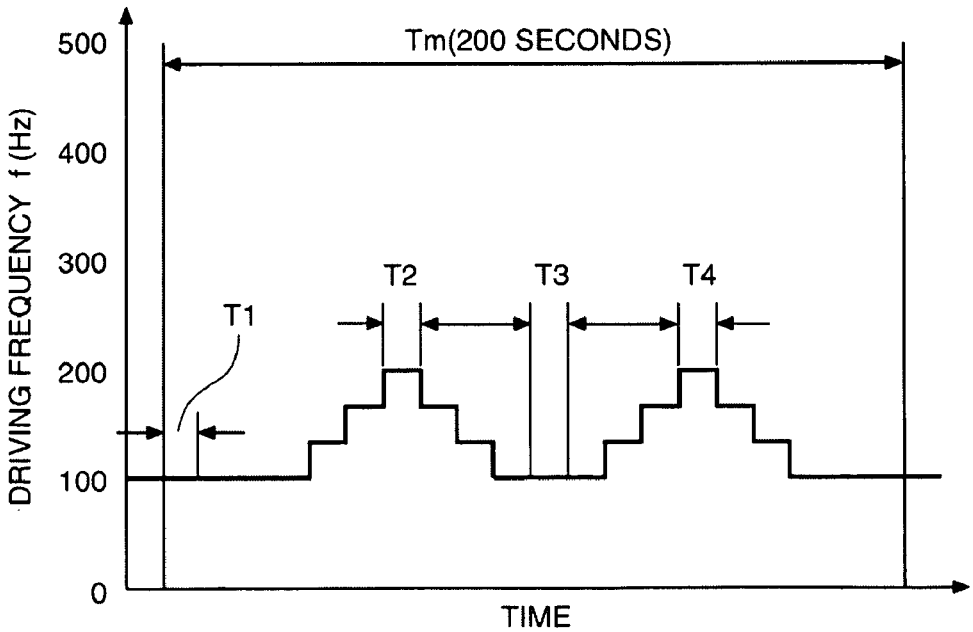

The driving frequency modulating unit 614 of the driving control unit 210 (FIG. 3) modulates a frequency of an AC pulse current within a modulation period. FIGS. 5A and 5B are explanatory views illustrating how a frequency of an AC pulse current is modulated. FIG. 5A is different from FIG. 4 in that temporal changes in the anode duty ratios Das and Dam are shown for only one modulation period (1×Tm). Since the other points are almost similar to those described in FIG. 4, an explanation thereof will be omitted. FIG. 5B illustrates the temporal change of a frequency (driving frequency) f of an AC pulse current within the modulation period Tm.

As shown in FIG. 5B, the driving frequency f is set to a highest frequency (200 Hz) in periods T2 and T4 for which the anode duty ratio Das of the auxiliary mirror side electrode 542 is set to a predetermined reference value (40% in the example shown in FIG. 5A). The driving frequency f sequentially decreases for every step time Ts from the periods T2 and T4 and is set to a frequency (100 Hz), which corresponds to ½ of the frequency f (=200 Hz) in the periods T2 and T4, in the period T1 for which the anode duty ratio Das of the auxiliary mirror side electrode 542 is set to a maximum value and the period T3 for which the anode duty ratio Das of the auxiliary mirror side electrode 542 is set to a minimum value.

In addition, as shown in FIG. 5B, in the first example, the driving frequency f is decreased at almost equal intervals over three steps when the driving frequency f is decreased from the highest frequency (200 Hz) to the lowest frequency (100 Hz). However, the driving frequency may not necessarily be decreased at equal intervals. In addition, the number of steps when decreasing the driving frequency f from the highest frequency (200 Hz) to the lowest frequency (100 Hz) may also be suitably changed.

Figure 6A:
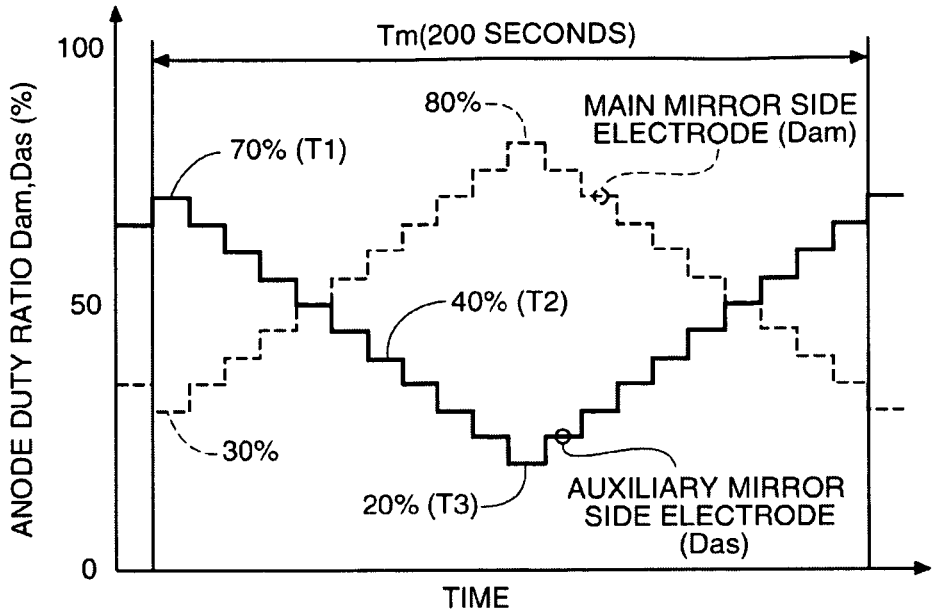
FIGS. 6A and 6B are explanatory views illustrating how an anode duty ratio and a driving frequency are modulated to drive a discharge lamp.
Figure 6B:
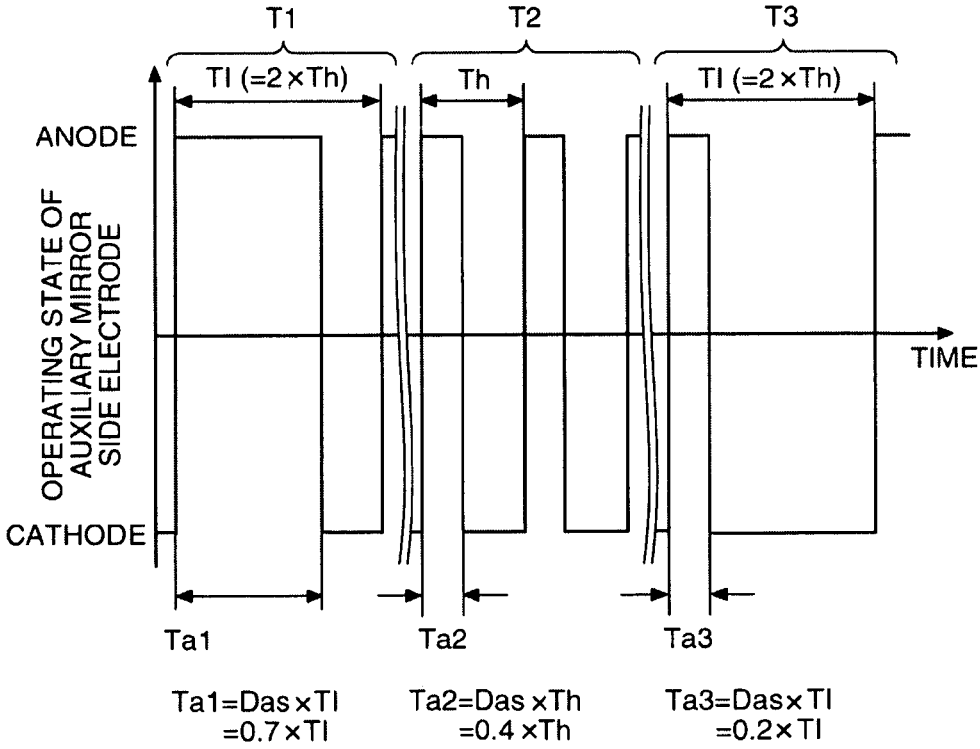

FIGS. 6A and 6B are explanatory views illustrating how the anode duty ratios Das and Dam and the driving frequency f are modulated to drive the discharge lamp 500 as shown in FIGS. 4, 5A, and 5B. Since FIG. 6A is almost the same as FIG. 5A, an explanation thereof will be omitted herein. FIG. 6B is a graph illustrating a temporal change of an operating state of the auxiliary mirror side electrode 542 in three periods T1 to T3 in which the anode duty ratio Das of the auxiliary mirror side electrode 542 in FIG. 6A is set to different values (70%, 40%, and 20%).

As described above, the driving frequency f in each of the periods T1 and T3 for which the anode duty ratio Das is set to the maximum value or the minimum value is set to ½ of that in each of the periods T2 and T4 for which the anode duty ratio Das is set to the reference value (40%). Accordingly, as shown in FIG. 6B, a switching period T1, in which the polarity of the auxiliary mirror side electrode 542 switches, in the period T1 for which the anode duty ratio Das is set to a maximum value and the period T3 for which the anode duty ratio Das is set to a minimum value is twice a switching period Th in the period T2 for which the anode duty ratio Das is set to the reference value (40%). The anode duty ratio Das is modulated by setting anode times Ta1 to Ta3 of the auxiliary mirror side electrode 542 to times determined from the switching periods T1 and Th in each of the periods T1 to T3 and the anode duty ratio Das.

Figure 7A:
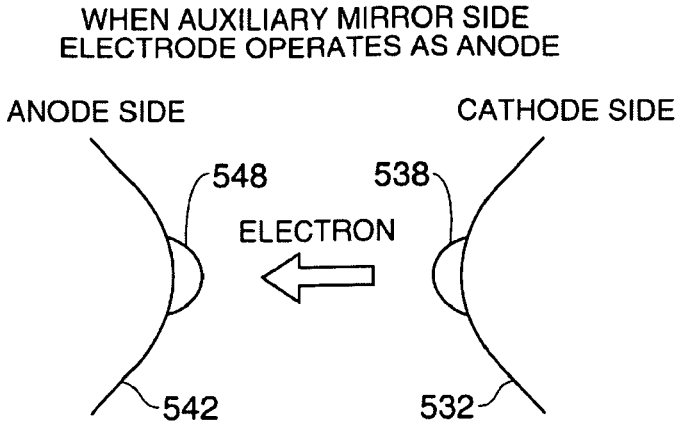
FIGS. 7A to 7C are explanatory views schematically illustrating the shape of an auxiliary mirror side electrode when the anode duty ratio and the driving frequency are modulated.
Figure 7B:
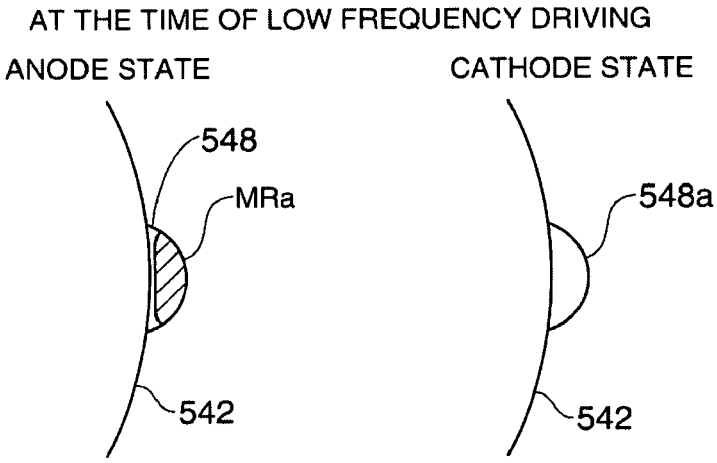
Figure 7C:
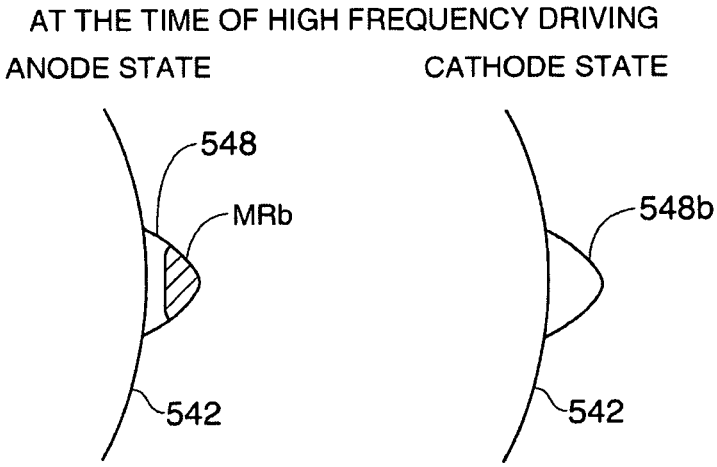

FIGS. 7A to 7C are explanatory views schematically illustrating the shape of the auxiliary mirror side electrode 542 when the anode duty ratios Das and Dam and the driving frequency f are modulated as described above. FIG. 7A illustrates a state when the auxiliary mirror side electrode 542 operates as an anode. As shown in FIG. 7A, projections 538 and 548 are formed on the discharge electrodes 532 and 542 so as to protrude toward the opposite discharge electrodes, respectively. FIG. 7B illustrates a state of the projection 548 provided on the auxiliary mirror side electrode 542 when an operating state of the auxiliary mirror side electrode 542 has changed from an anode state to a cathode state in a condition where the driving frequency f is low. FIG. 7C illustrates a state of the projection 548 provided on the auxiliary mirror side electrode 542 when the operating state of the auxiliary mirror side electrode 542 has changed from the anode state to the cathode state in a condition where the driving frequency f is high.

As shown in FIG. 7A, when the auxiliary mirror side electrode 542 operates as an anode, electrons are emitted from the main mirror side electrode 532 to collide with the auxiliary mirror side electrode 542. By the collision of electrons, the kinetic energy of electrons is converted into the heat energy in the auxiliary mirror side electrode 542 on the anode side. As a result, the temperature of the auxiliary mirror side electrode 542 rises. On the other hand, since the collision of electrons does not occur in the main mirror side electrode 532 on the cathode side, the temperature of the main mirror side electrode 532 decreases due to heat conduction, emission, and the like. Similarly, in the period for which the auxiliary mirror side electrode 542 operates as a cathode, the temperature of the auxiliary mirror side electrode 542 falls and the temperature of the main mirror side electrode 532 rises.

Thus, since the temperature of the auxiliary mirror side electrode 542 rises when the auxiliary mirror side electrode 542 is in the anode state, a melted portion caused by melting of an electrode material is formed in the projection 548 provided in the auxiliary mirror side electrode 542. Then, when the polarity of the auxiliary mirror side electrode 542 changes from the anode to the cathode, the temperature of the auxiliary mirror side electrode 542 falls and the melted portion formed on the tip of the projection 548 starts to be solidified. Thus, since the melted portions are formed in the projections 538 and 548 and the formed melted portions are solidified, the projections 538 and 548 are maintained in the protruding shapes protruding toward the opposite electrodes, respectively.

FIGS. 7B and 7C illustrate how the driving frequency f has an effect on the shape of the projection 548. When the driving frequency f is low, the temperature of the projection 548 of the auxiliary mirror side electrode 542 in the anode state rises over a wide range. In addition, when the driving frequency f is low, the force applied to a melted portion MRa due to an electric potential difference between the auxiliary mirror side electrode 542 and the opposite main mirror side electrode 532 is also applied to a large region of the melted portion MRa. As a result, as shown in FIG. 7B, the flat melted portion MRa is formed in the projection 548 of the auxiliary mirror side electrode 542 in the anode state. Then, when the auxiliary mirror side electrode 542 changes to the cathode state, the melted portion MRa is solidified and the projection 548*a* has a flat shape. On the other hand, when the driving frequency f is high, the range where the temperature rises in the projection 548 of the auxiliary mirror side electrode 542 in the anode state is decreased. Accordingly, the force applied to a melted portion MRb is concentrated on a central portion of the melted portion MRb. As a result, as shown in FIG. 7C, the long and narrow melted portion MRb is formed in the projection 548 and the shape of a projection 548*b* after the melted portion MRb is solidified becomes long and narrow.

As described above, since the temperature of the auxiliary mirror side electrode 542 rises while the auxiliary mirror side electrode 542 is in the anode state and falls while the auxiliary mirror side electrode 542 is in the cathode state, the temperature of the auxiliary mirror side electrode 542 rises as the anode duty ratio Das increases. Therefore, in a state where the anode duty ratio Das is high, a time until a melted portion is solidified after the auxiliary mirror side electrode 542 changes from the anode state to the cathode state becomes long. As a result, the shape of a projection becomes flatter than that of the melted portion formed in the anode state. Moreover, in a state where the anode duty ratio Das is low, a time until a melted portion is formed after the auxiliary mirror side electrode 542 changes from the cathode state to the anode state becomes long. For this reason, a melted portion with a desirable shape is difficult to be formed.

On the other hand, in the first example, the driving frequency f is set high in a period for which the anode duty ratio Das of the auxiliary mirror side electrode 542 has an intermediate value (40%) of the duty ratio modulation range (20% to 70%). Accordingly, growth of the long and narrow projection 548*b* is accelerated from the central portion of the long and narrow melted portion MRb. Moreover, the driving frequency f is set low in a state where the anode duty ratio Das is high. Accordingly, formation of the larger projection 548*a* is accelerated. Thus, since formation of the large projection and growth of the long and narrow projection are performed, the projection 548 extends toward the opposite main mirror side electrode 532.

Furthermore, as shown in FIG. 5A, in the periods T2 and T4 for which the anode duty ratio Das of the auxiliary mirror side electrode 542 has the intermediate value (40%) of the duty ratio modulation range (20% to 70%), the anode duty ratio Dam of the main mirror side electrode 532 also has an intermediate value (60%) of a duty ratio modulation range (30% to 80%). Accordingly, similar to the projection 548 of the auxiliary mirror side electrode 542, the projection 538 of the main mirror side electrode 532 also extends toward the opposite auxiliary mirror side electrode 542.

Furthermore, although the driving frequency f is modulated in a stepwise manner in the first example, it is not necessary to modulate the driving frequency f in the stepwise manner. However, by modulating the driving frequency f in the stepwise manner like the first example, the large projection 548*a* is formed and then the formed projection sequentially changes to the long and narrow shape. Accordingly, since the large projection deforms to have a long and narrow in a sequential manner, the formed projection has a preferable shape, such as a conical shape or a cylindrical shape. Thus, since the occurrence position of arc is stabilized by making the formed projection have a preferable shape, it is more preferable to modulate the driving frequency f in a stepwise manner.

Thus, in the first example, the driving frequency f is set high in the period for which the anode duty ratio Das has an intermediate value and is set low in the period for which the anode duty ratio Das is high. Therefore, since the projection extends toward the opposite discharge electrode to suppress an increase in the lamp voltage of the discharge lamp 500, the discharge lamp 500 can be used over a longer period of time.

B. Second Example

Figure 8:
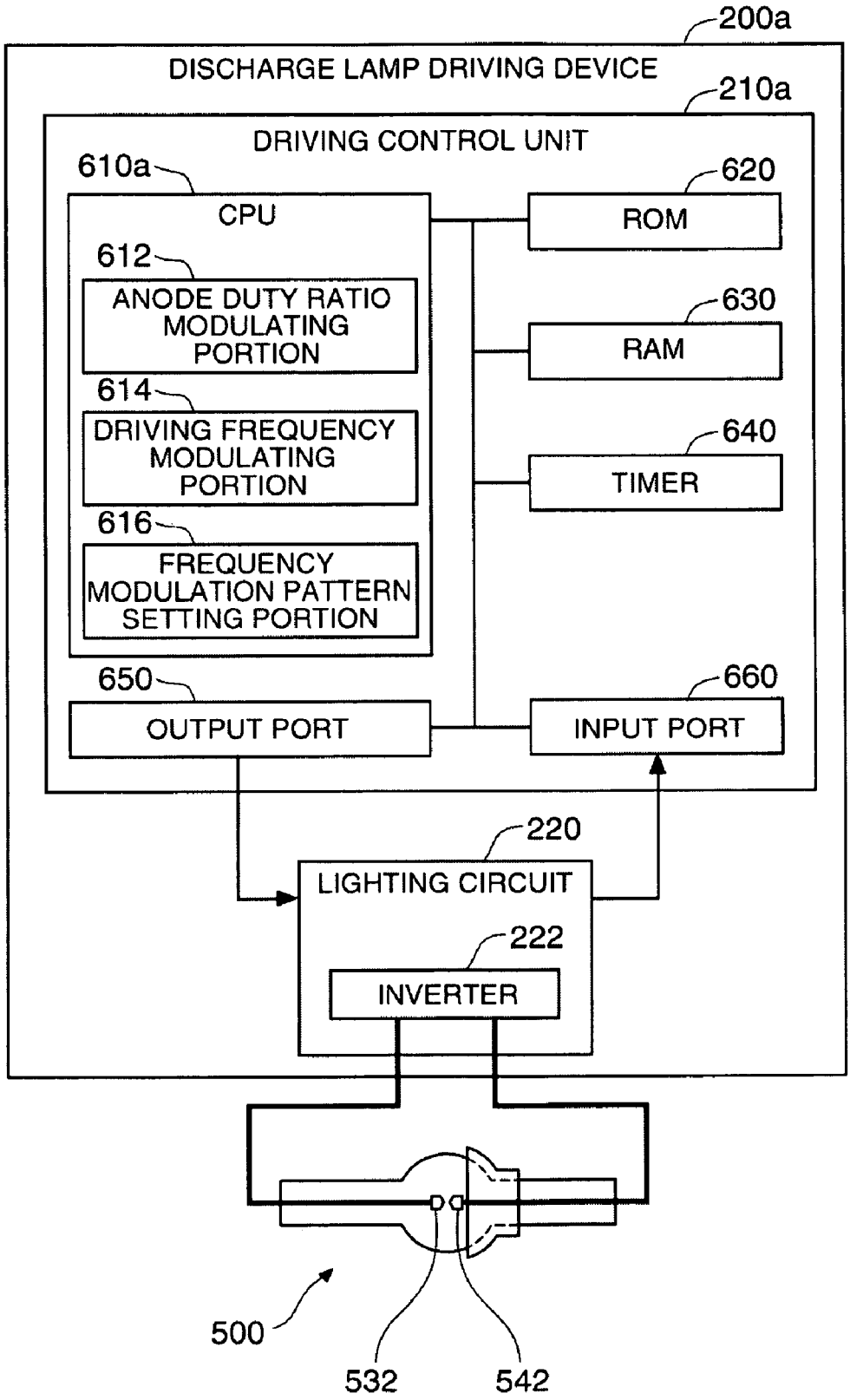
FIG. 8 is a block diagram illustrating the configuration of a discharge lamp driving device in a second example.

FIG. 8 is a block diagram illustrating the configuration of a discharge lamp driving device 200*a* in a second example. The discharge lamp driving device 200*a* in the second example is different from the discharge lamp driving device in the first example shown in FIG. 3 in that a CPU 610*a* has a function as a frequency modulation pattern setting unit 616. The other points are the same as in the first example.

The frequency modulation pattern setting unit 616 changes a modulation pattern of a driving frequency (hereinafter, simply referred to as a 'modulation pattern'), which is set within a modulation period, on the basis of a deterioration state of the discharge lamp 500. Specifically, the CPU 610*a* acquires, through the input port 660, a lamp voltage as a parameter indicating the deterioration state of the discharge lamp 500. The frequency modulation pattern setting unit 616 sets a modulation pattern of a driving frequency in the driving frequency modulating unit 614 on the basis of the lamp voltage acquired as described above. The driving frequency modulating unit 614 controls the lighting circuit 220 such that the driving frequency changes according to a modulation pattern set by the driving frequency modulation pattern setting unit 616.

Figure 9:
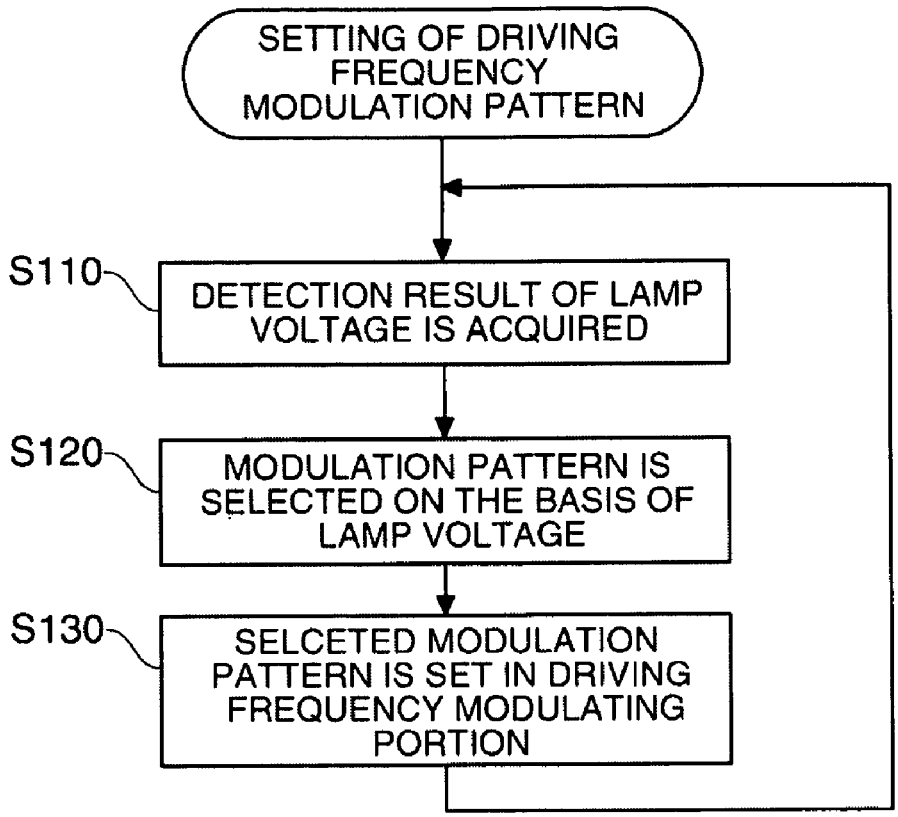
FIG. 9 is a flow chart illustrating the flow of processing when a frequency modulation pattern setting unit sets a modulation pattern of a driving frequency.

FIG. 9 is a flow chart illustrating the flow of processing when the frequency modulation pattern setting unit 616 sets a modulation pattern of a driving frequency. This processing is always executed in the discharge lamp driving device 200, for example, when the projector 1000 starts or while the discharge lamp 500 is lighting. However, the processing for setting the modulation pattern of a driving frequency does not necessarily need to be executed all the time. For example, the processing for setting the modulation pattern may also be executed when the CPU 610 receives an interval signal by configuring the timer 640 (FIG. 8) to generate the interval signal whenever a predetermined lighting time (for example, 10 hours) of the discharge lamp 500 elapses.

In step S110, the frequency modulation pattern setting unit 616 acquires a lamp voltage that the CPU 610 has acquired through the input port 660. Then, in step S120, the frequency modulation pattern setting unit 616 selects a modulation pattern on the basis of the acquired lamp voltage. Specifically, the frequency modulation pattern setting unit 616 selects a modulation pattern with reference to data that is stored in the ROM 620 or the RAM 630 and matches a range of a lamp voltage with a modulation pattern. In step S130, the frequency modulation pattern setting unit 616 sets the selected modulation pattern in the driving frequency modulating unit 614. Then, the driving frequency is modulated by the pattern set according to the lamp voltage. After step S130, the control returns to step S110 and the processing of steps S110 to S130 is repeatedly executed.

Figure 10A:
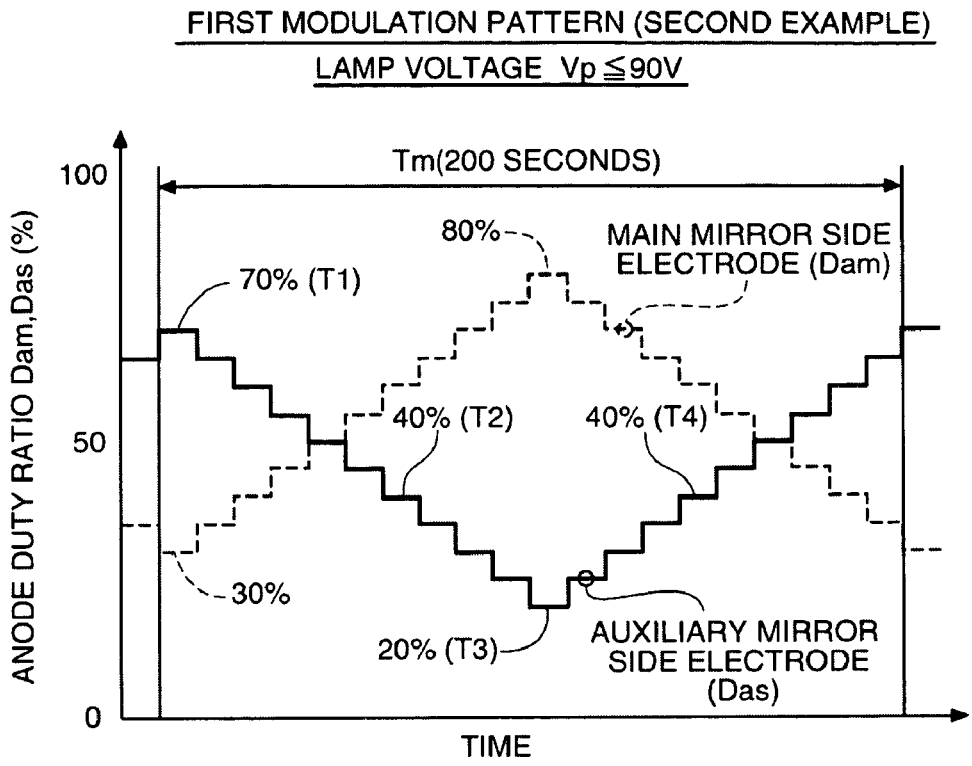
FIGS. 10A and 10B are explanatory views illustrating an example of a first modulation pattern in the second example.
Figure 10B:
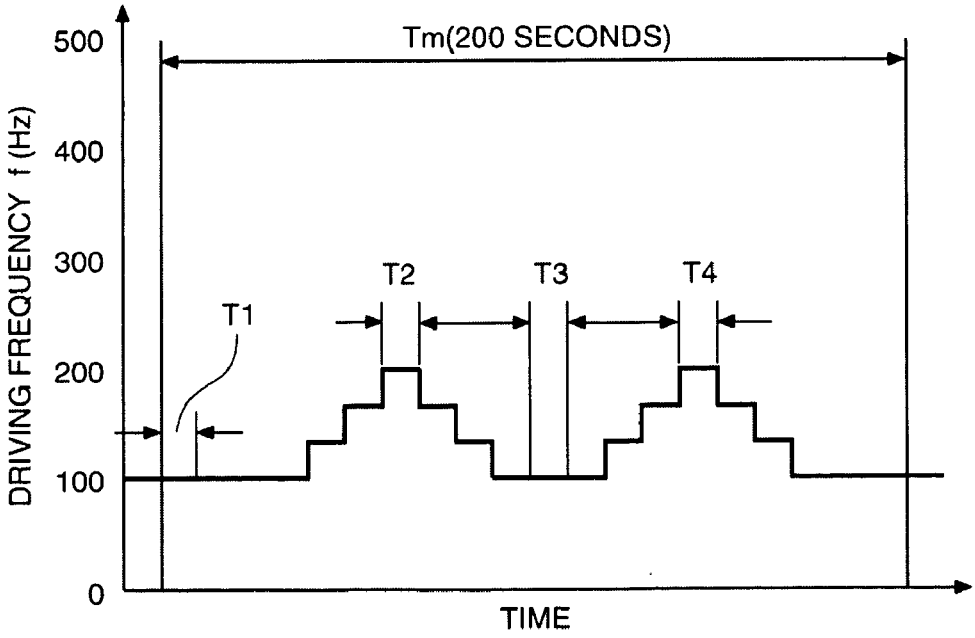
Figure 11A:
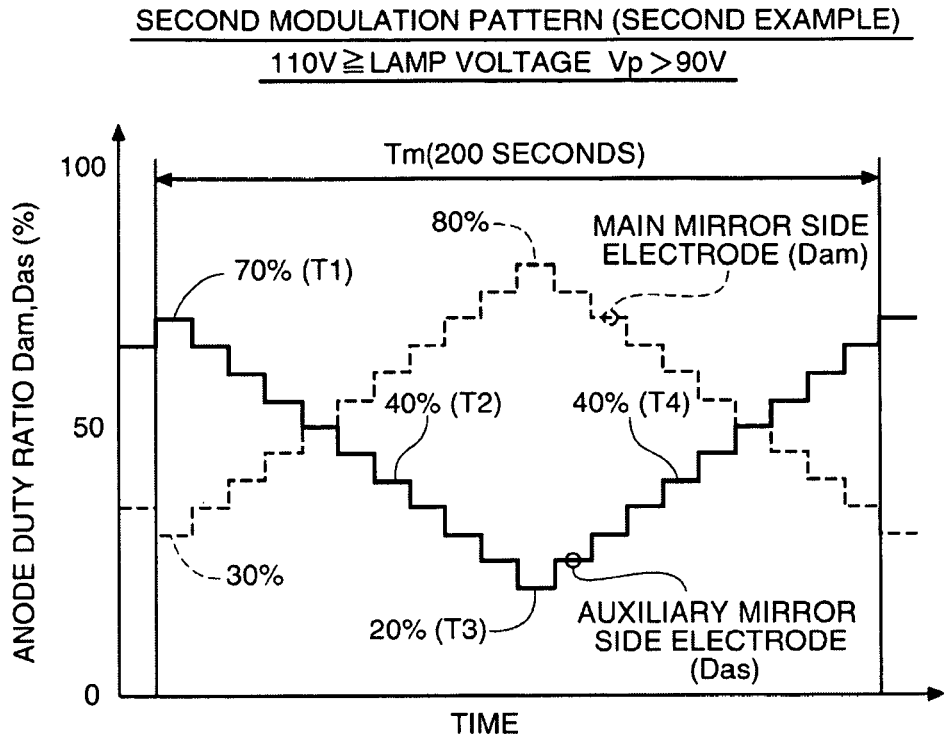
FIGS. 11A and 11B are explanatory views illustrating an example of a second modulation pattern in the second example.
Figure 11B:
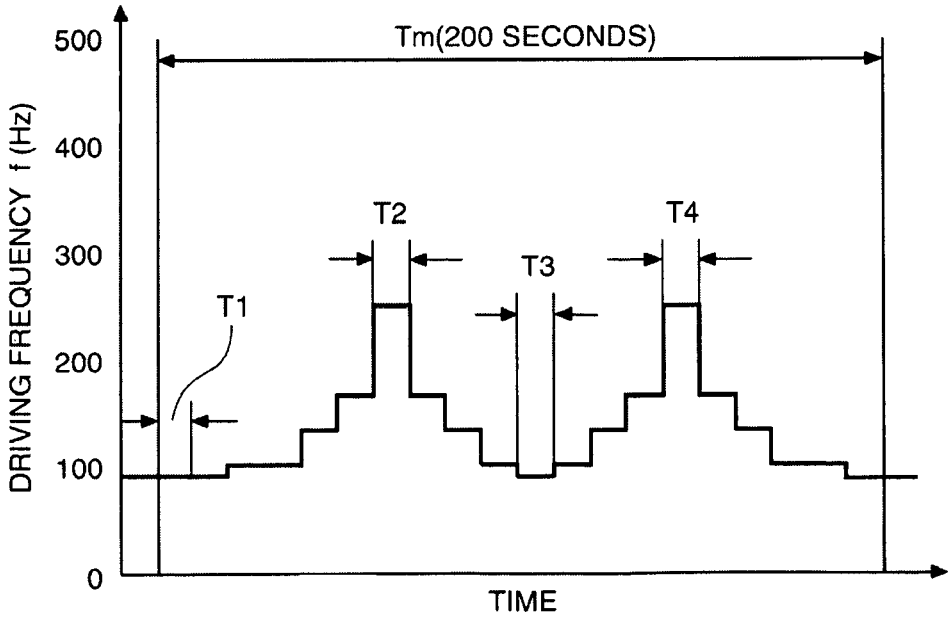
Figure 12A:
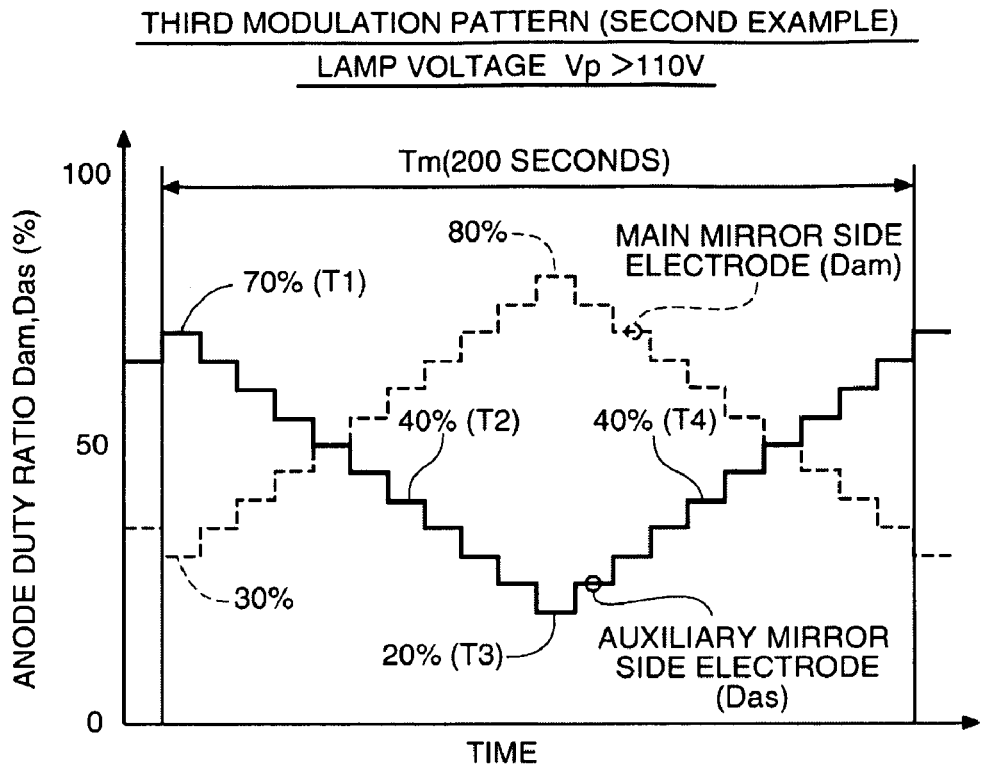
FIGS. 12A and 12B are explanatory views illustrating an example of a third modulation pattern in the second example.
Figure 12B:
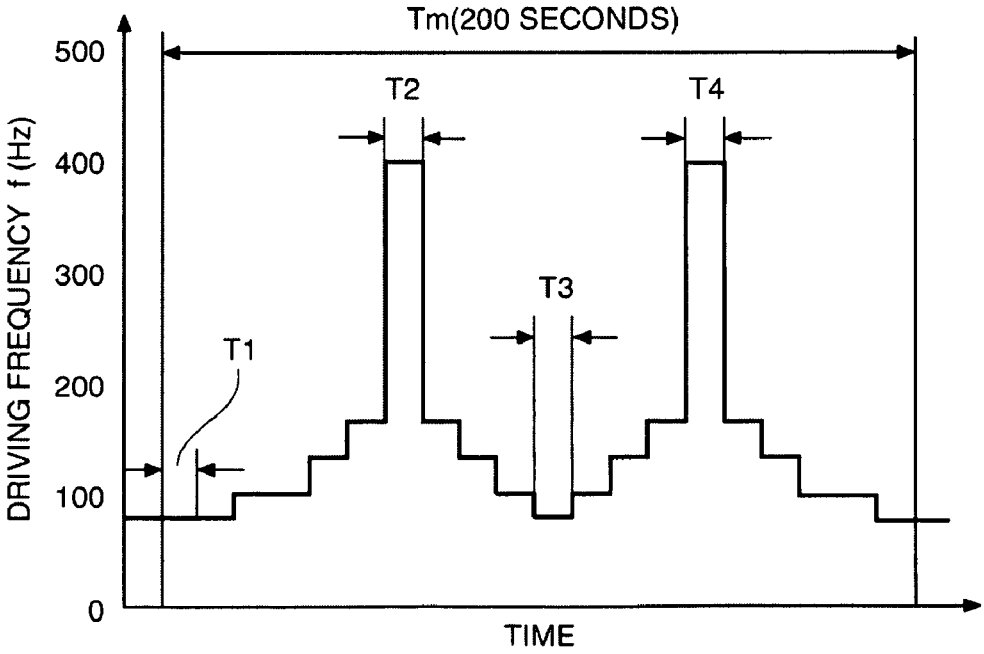

FIGS. 10A to 12B illustrate an example of a modulation pattern set on the basis of a lamp voltage Vp. In the second example where the lamp voltage (initial lamp voltage) in the initial state of the discharge lamp 500 is about 65 V, the lamp voltage Vp is divided into three ranges with 90 V and 110 V as boundaries. When the lamp voltage Vp is 90 V or less, a first modulation pattern shown in FIGS. 10A and 10B is used. When the lamp voltage Vp is larger than 90 V and equal to or smaller than 110 V, a second modulation pattern shown in FIGS. 11A and 11B is used. When the lamp voltage Vp exceeds 110 V, a third modulation pattern shown in FIGS. 12A and 12B is used.

When the lamp voltage Vp rises gradually with the use of the discharge lamp 500, the modulation pattern changes from the first modulation pattern shown in FIGS. 10A and 10B sequentially to the second modulation pattern shown FIGS. 11A and 11B and the third modulation pattern shown in FIGS. 12A and 12B. On the other hand, when the lamp voltage Vp falls due to extension of a projection, a modulation pattern corresponding to the lowered lamp voltage Vp is used. In addition, the number of ranges of the lamp voltage Vp and the boundary value that specifies the range of the lamp voltage Vp are not necessarily limited to those described above. The boundary value is suitably set on the basis of the initial lamp voltage, the maximum rating of the discharge lamp 500, and the like.

FIGS. 10A and 10B illustrate the first modulation pattern used when the lamp voltage Vp is 90 V or less. Since FIGS. 10A and 10B are almost the same as FIGS. 5A and 5B, an explanation thereof will be omitted herein.

FIGS. 11A and 11B illustrate the second modulation pattern used when the lamp voltage Vp exceeds 90 V and is equal to or smaller than 110 V. FIG. 11A is the same as FIG. 10A. In the second modulation pattern, as shown in FIG. 11B, the driving frequency f in the periods T2 and T4 for which the anode duty ratio Das of the auxiliary mirror side electrode 542 is set to the reference value (40%) is set to 250 Hz which is higher than that in the first modulation pattern shown in FIG. 10B. In addition, the driving frequency fin the period T1, for which the anode duty ratio Das is set to the maximum value (70%), and the period T3, for which the anode duty ratio Das is set to the minimum value (20%), is set to 90 Hz which is lower than that in the first modulation pattern.

FIGS. 12A and 12B illustrate the third modulation pattern used when the lamp voltage Vp exceeds 110 V. FIG. 12A is the same as FIG. 5A. In the third modulation pattern, as shown in FIG. 12B, the driving frequency f in the periods T2 and T4 for which the anode duty ratio Das of the auxiliary mirror side electrode 542 is set to the reference value (40%) is set to 400 Hz which is higher than that in the second modulation pattern shown in FIG. 11B. In addition, the driving frequency f in the period T1, for which the anode duty ratio Das is set to the maximum value (70%), and the period T3, for which the anode duty ratio Das is set to the minimum value (20%), is set to 80 Hz which is lower than that in the second modulation pattern.

In the second example, the driving frequency f in the periods T2 and T4 for which the anode duty ratio Das of the auxiliary mirror side electrode 542 is set to the intermediate value is set high as the lamp voltage Vp rises.

Generally, since the shape of the long and narrow projection 538*b* shown in FIGS. 7A to 7C becomes longer and narrower as the driving frequency f increases, extension of the projection toward the opposite discharge electrode is accelerated.

Accordingly, when the discharge electrodes 532 and 542 wear away to cause the lamp voltage Vp to rise, extension of a projection is accelerated and an increase in the lamp voltage Vp is suppressed. On the other hand, when the discharge electrodes 532 and 542 do not wear away yet and the lamp voltage Vp is low, extension of a projection is suppressed and an excessive decrease in the lamp voltage Vp is suppressed. Thus, in the second example, an increase in the lamp voltage Vp occurring as the discharge electrodes 532 and 542 wear away is suppressed, and an excessive decrease in the lamp voltage Vp in a state where the operating time of the discharge lamp 500 is short is suppressed. As a result, the discharge lamp 500 can be used over a longer period of time. Moreover, also in the second example, modulation of the driving frequency f is performed in a stepwise manner. Accordingly, similar to the first example, a projection with a desirable shape is formed and the arc occurrence position is stabilized.

In addition, a modulation pattern different from those shown in FIGS. 10A to 12B may be generally used as a modulation pattern corresponding to the range of the lamp voltage Vp as long as the driving frequency f in the periods T2 and T4 for which the anode duty ratio Das is set to an intermediate value increases as the lamp voltage Vp rises. For example, although the driving frequency f in the periods T1 and T3 for which the anode duty ratio Das is set to the maximum value or the minimum value is set to decrease as the lamp voltage Vp rises in FIGS. 10A to 12B, the driving frequency f in the periods T1 and T3 may not be set to decrease. However, it is more preferable to set the driving frequency f in the periods T1 and T3 to decrease from a point of view that the projection 548*a* formed at the time of low frequency driving shown in FIG. 7B can be made larger.

C. Third Example

FIGS. 13A to 15B are explanatory views illustrating an example of a modulation pattern in a third example. The third example is different from the second example in that the driving frequency f is set to be highest in the period T1 for which the anode duty ratio Das of the auxiliary mirror side electrode 542 is set to the maximum value and the period T3 for which the anode duty ratio Das of the auxiliary mirror side electrode 542 is set to the minimum value. The other points are the same as in the second example.

Figure 13A:
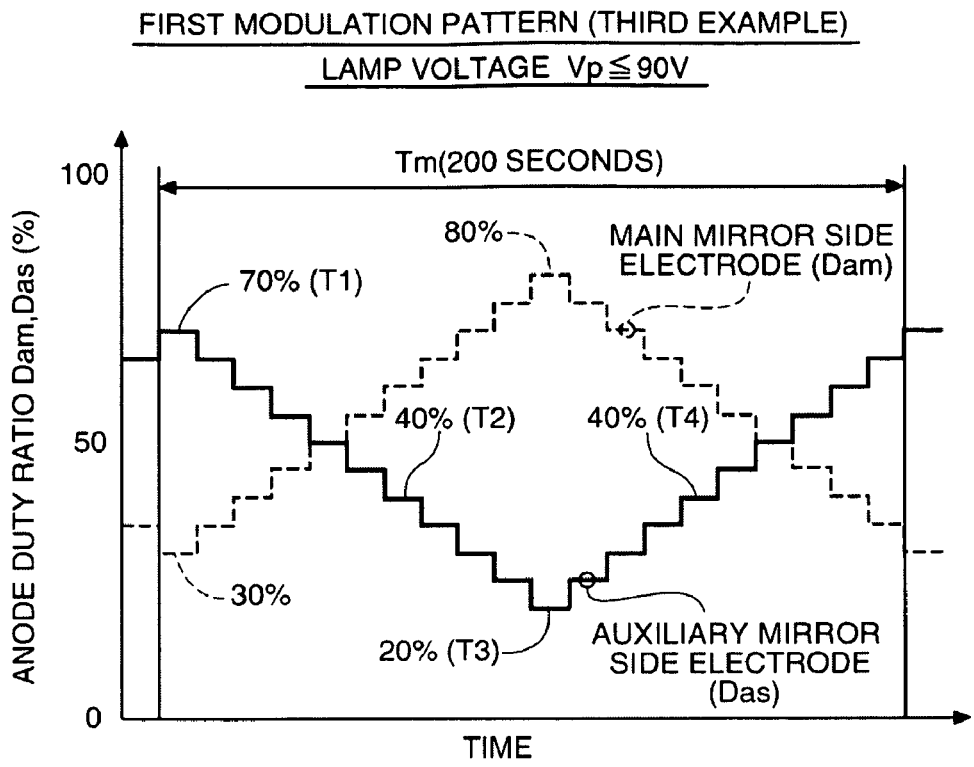
FIGS. 13A and 13B are explanatory views illustrating an example of a first modulation pattern in a third example.
Figure 13B:
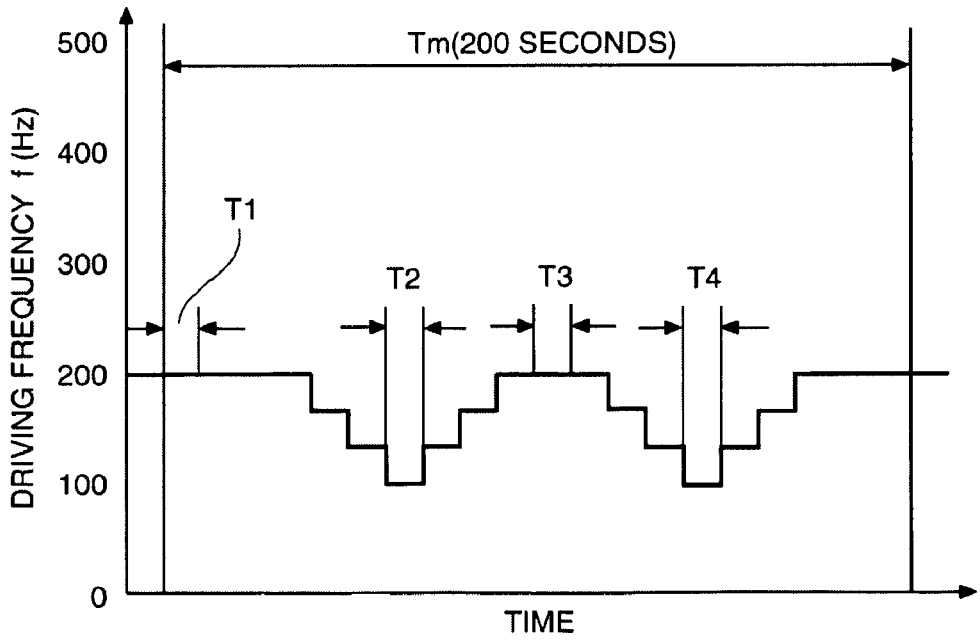

FIGS. 13A and 13B illustrate a first modulation pattern used when the lamp voltage Vp is 90 V or less. FIG. 13A is the same as FIG. 5A. In the first modulation pattern in the third example, as shown in FIG. 13B, the driving frequency f in the periods T2 and T4 for which the anode duty ratio Das of the auxiliary mirror side electrode 542 is set to the reference value (40%) is set to a lowest frequency (100 Hz). In addition, the driving frequency f in the period T1, for which the anode duty ratio Das is set to the maximum value (70%), and the period T3, for which the anode duty ratio Das is set to the minimum value (20%), is set to a highest frequency (200 Hz).

Figure 14A:
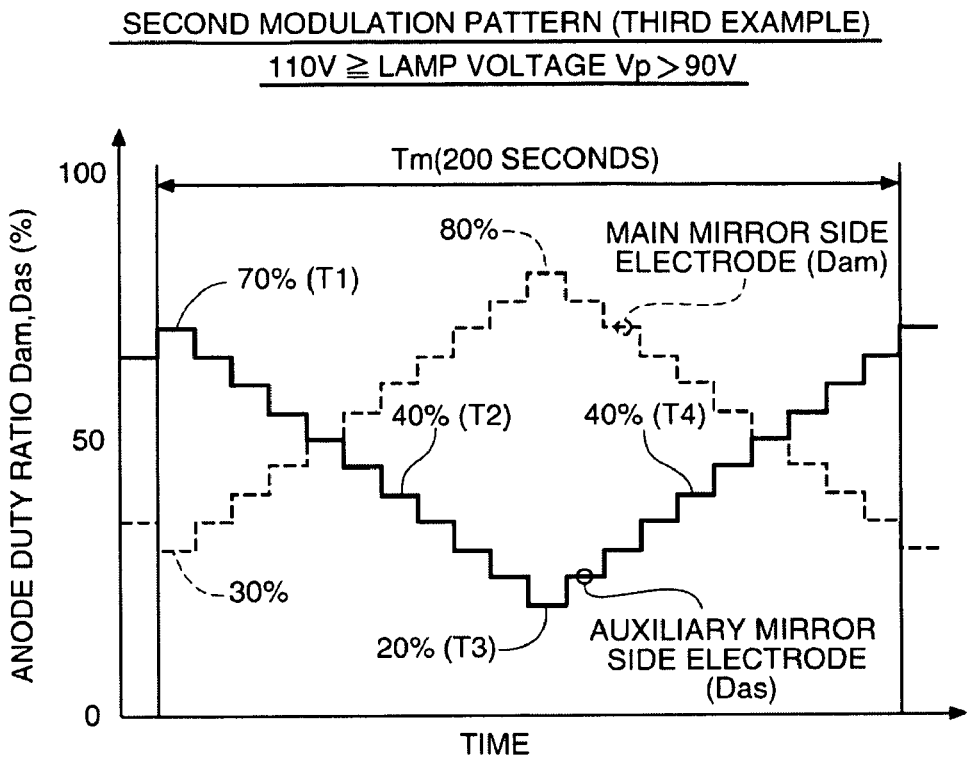
FIGS. 14A and 14B are explanatory views illustrating an example of a second modulation pattern in the third example.
Figure 14B:
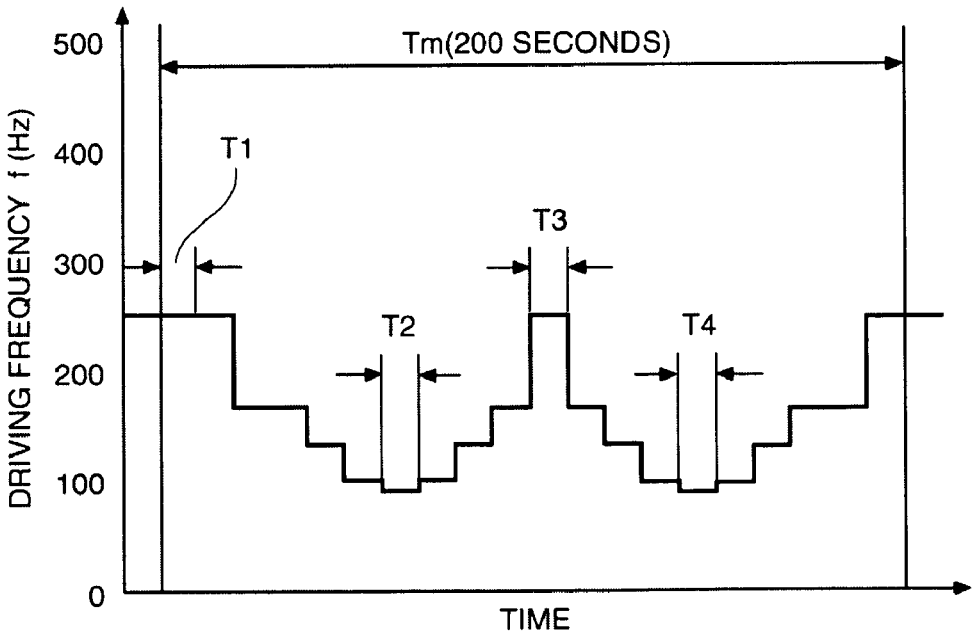

FIGS. 14A and 14B illustrate a second modulation pattern used when the lamp voltage Vp exceeds 90 V and is equal to or smaller than 110 V. FIG. 14A is the same as FIG. 13A. In the second modulation pattern in the third example, as shown in FIG. 14B, the driving frequency f in the periods T2 and T4 for which the anode duty ratio Das of the auxiliary mirror side electrode 542 is set to the reference value (40%) is set to 90 Hz which is lower than that in the first modulation pattern shown in FIG. 13B. In addition, the driving frequency f in the period T1, for which the anode duty ratio Das is set to the maximum value (70%), and the period T2, for which the anode duty ratio Das is set to the minimum value (20%), is set to 250 Hz which is higher than that in the first modulation pattern.

Figure 15A:
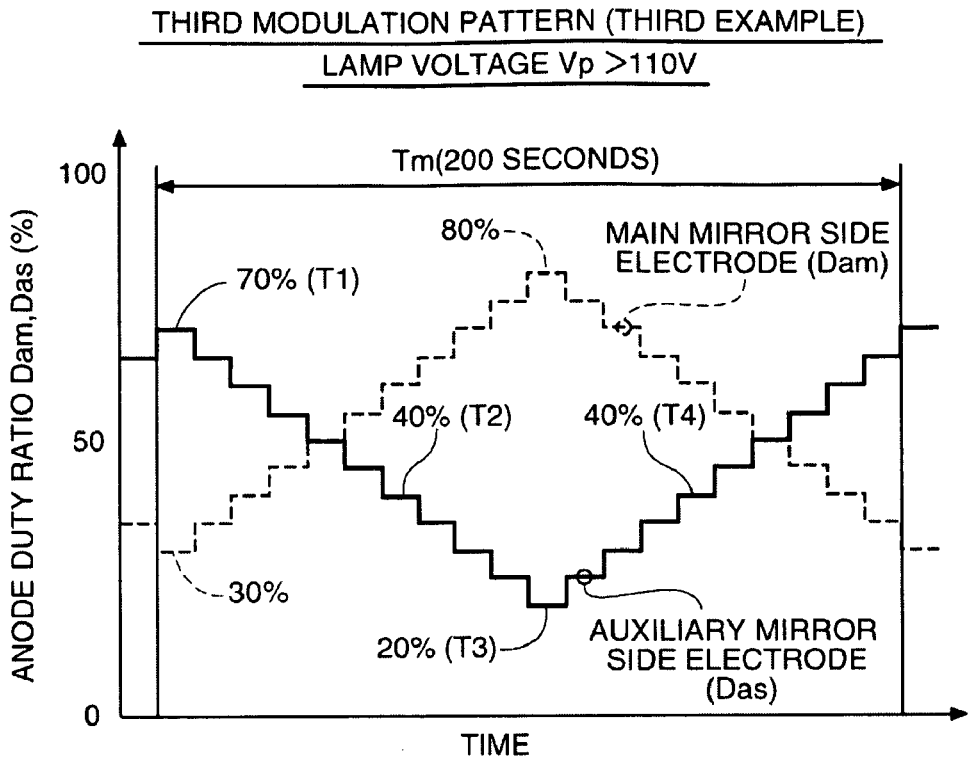
FIGS. 15A and 15B are explanatory views illustrating an example of a third modulation pattern in the third example.
Figure 15B:
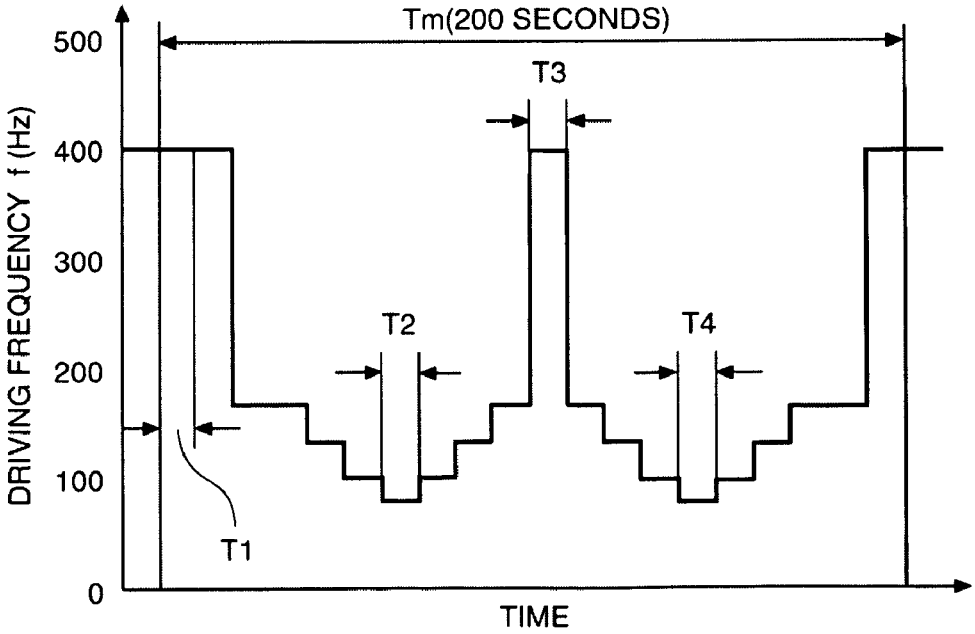

FIGS. 15A and 15B illustrate a third modulation pattern used when the lamp voltage Vp exceeds 110 V. FIG. 15A is the same as FIG. 13A. In the third modulation pattern in the third example, as shown in FIG. 15B, the driving frequency f in the periods T2 and T4 for which the anode duty ratio Das of the auxiliary mirror side electrode 542 is set to the reference value (40%) is set to 80 Hz which is lower than that in the second modulation pattern shown in FIG. 14B. In addition, the driving frequency f in the period T1, for which the anode duty ratio Das is set to the maximum value (70%), and the period T3, for which the anode duty ratio Das is set to the minimum value (20%), is set to 400 Hz which is higher than that in the second modulation pattern.

In the third example, the driving frequency f is set high in the periods T1 and T3 for which the anode duty ratios Das and Dam are set to the maximum values. In general, when the driving frequency f increases, the discharge electrodes 532 and 542 become difficult to melt even if the anode duty ratios Das and Dam are increased. Accordingly, if the driving frequency f is increased in a state where the anode duty ratios Das and Dam are high, melted states of the discharge electrodes 532 and 542 become similar to those in a case where the anode duty ratios Das and Dam are set to intermediate values. In addition, by maintaining the melted states of the projections 538 and 548 (FIGS. 7A to 7C) appropriately by taking such intermediate states, deformation of the discharge electrodes 532 and 542 and the projections 538 and 548 can be suppressed. In addition, if the driving frequency f decreases, the discharge electrodes 532 and 542 easily melt even in the case where the anode duty ratios Das and Dam are set to the intermediate values. Accordingly, if the driving frequency f is decreased in a state where the anode duty ratios Das and Dam are set to the intermediate values, formation of a large projection can be accelerated like the case where the anode duty ratios Das and Dam are set to high values.

Thus, in the third example, deformation of the discharge electrodes 532 and 542 and the projections 538 and 548 is suppressed in a state where the lamp voltage Vp is high. As a result, deterioration of the discharge lamp 500 caused by deformation of the discharge electrodes 532 and 542 or the projections 538 and 548 is suppressed. Moreover, in a state where the lamp voltage Vp is low, extension of a projection is suppressed and an excessive decrease in the lamp voltage Vp is suppressed. As a result, the discharge lamp 500 can be used over a longer period of time. Moreover, also in the third example, modulation of the driving frequency f is performed in a stepwise manner. Accordingly, similar to the first and second examples, a projection with a desirable shape is formed and the arc occurrence position is stabilized.

D. Fourth Example

Figure 16:
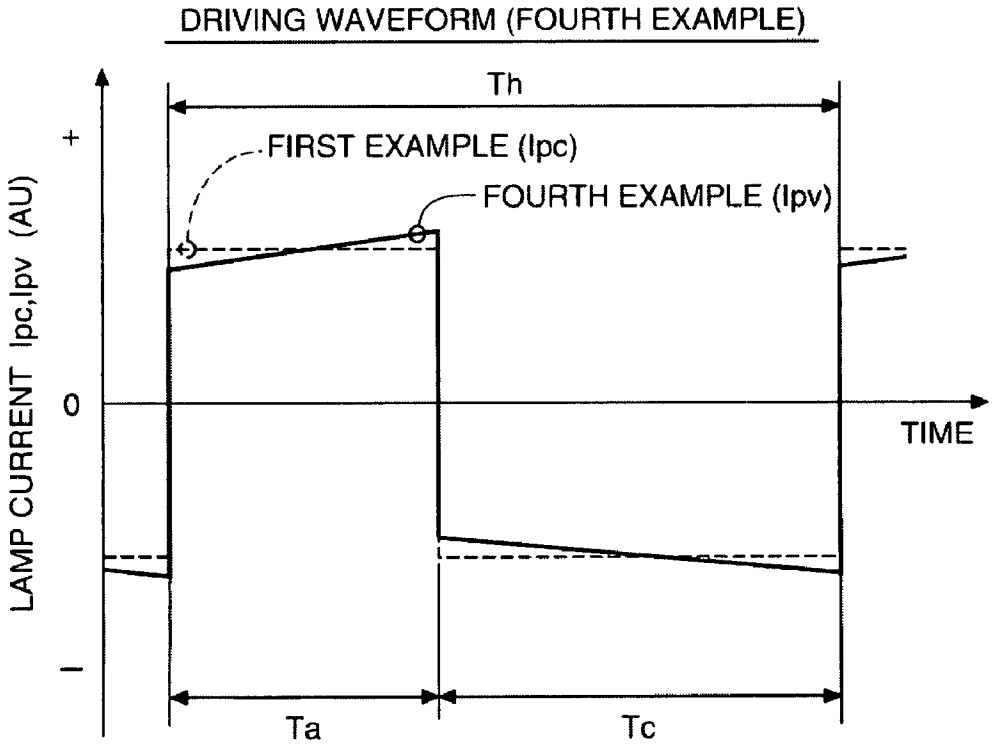
FIG. 16 is an explanatory view schematically illustrating a driving waveform in a fourth example.

FIG. 16 is an explanatory view schematically illustrating an AC pulse current waveform in a fourth example. The fourth example is different from the first example in that a different waveform (hereinafter, referred to as a 'non-rectangular waveform') from the rectangular waveform is used as the waveform of the AC pulse current. The other points are the same as in the first example.

FIG. 16 is a graph illustrating temporal changes of lamp currents Ipc and Ipv (discharge currents) supplied to the discharge lamp 500. In FIG. 16, the positive directions of the lamp currents Ipc and Ipv indicate directions in which the currents flow from the auxiliary mirror side electrode 542 toward the main mirror side electrode 532. That is, the auxiliary mirror side electrode 542 operates as an anode in a period Ta for which the lamp currents Ipc and Ipv are positive values and operates as a cathode in a period Tc for which the lamp currents Ipc and Ipv are negative values. A solid line of FIG. 16 indicates the temporal change of the lamp current Ipv in the fourth example. A dotted line indicates the temporal change of the lamp current Ipc in the first example. Moreover, in the following description, the waveform indicating the temporal change of each of the lamp currents Ipc and Ipv is also called a 'driving waveform'.

As shown in FIG. 16, a driving waveform in the fourth example shown by the solid line is a waveform obtained by superimposing a lamp wave on a rectangular wave which is a driving waveform in the first example shown by the broken line. Accordingly, the lamp current Ipv in the anode period Ta for which the auxiliary mirror side electrode 542 is in the anode state linearly rises from a front end of the period toward a rear end thereof. Thus, when the lamp current Ipv becomes large at the rear end of the anode period Ta, the temperature of the auxiliary mirror side electrode 542 immediately before the auxiliary mirror side electrode 542 switches from the anode state to the cathode state becomes higher.

Accordingly, when the driving frequency f is low as shown in FIG. 7B, the melted amount of the tip of the auxiliary mirror side electrode 542 increases. By the increase in the melted amount while the auxiliary mirror side electrode 542 is in the anode state, the melted portion MRa becomes larger. As a result, the projection 548*a* formed by switching of the auxiliary mirror side electrode 542 to the cathode state becomes larger. On the other hand, the lamp current Ipv in the cathode period Tc for which the auxiliary mirror side electrode is in the cathode state linearly falls from a front end of the period toward a rear end thereof. Accordingly, similar to the auxiliary mirror side electrode 542, the projection 538 of the main mirror side electrode 532 also becomes larger.

In addition, when the driving frequency is high as shown in FIG. 7C, the melted portion MRb formed in the projection 548 becomes larger. Moreover, since a force applied to the melted portion MRb also increases, extension of the projection 548*b* formed by switching of the auxiliary mirror side electrode 542 to the cathode state is further accelerated. On the other hand, the lamp current Ipv in the cathode period Tc for which the auxiliary mirror side electrode 542 is in the cathode state linearly falls from the front end of the period toward the rear end. Accordingly, similar to the auxiliary mirror side electrode 542, extension of the projection 538 of the main mirror side electrode 532 is also accelerated.

Thus, the lamp current Ipv in the fourth example is larger at the rear end of the anode period Ta than at the front end of the anode period Ta. In addition, the lamp current Ipv is smaller at the rear end of the cathode period Tc than at the front end of the cathode period Tc. In other words, an absolute value of the lamp current Ipv at the rear ends of the periods Ta and Tc for which the polarity is uniformly maintained is larger than that of the lamp current Ipv at the front ends of the periods Ta and Tc. Accordingly, in the fourth example, the projections 538 and 548 of the discharge electrodes 532 and 542 become large and extension of the projections 538 and 548 is further accelerated. As a result, an increase in the lamp voltage is further suppressed.

Furthermore, in the fourth example, a non-rectangular waveform is used as a driving waveform regardless of whether a driving frequency is high or low.

However, it may be possible to use a rectangular wave as the lamp current Ipv when the driving frequency is low and to change the driving waveform from the rectangular wave to the non-rectangular wave only when the driving frequency is high.

Specifically, it may be possible to use a rectangular wave as a driving waveform when the driving frequency is less than a predetermined reference frequency (for example, 400 Hz) and to use a non-rectangular wave as a driving waveform when the driving frequency is equal to or larger than the reference frequency. More specifically, in the first example, it may be possible to set a maximum value of the driving frequency f to 400 Hz and to use a non-rectangular wave in a period for which the driving frequency f is set to 400 Hz. In the second example, it may be possible to use a non-rectangular wave in the periods T2 and T4 of the third modulation pattern shown in FIG. 12B. Alternatively, in the third example, a non-rectangular wave may be used when the driving frequency f is set to 400 Hz.

Thus, by using a rectangular wave when the driving frequency is low and using a non-rectangular wave when the driving frequency is high, extension of a projection can be accelerated and a scroll noise, which occurs due to a change in the amount of light according to the change in the lamp current Ipv during the periods Ta and Tc, can be suppressed.

Furthermore, in this case, it is preferable to make an average value of the lamp current Ipv, which is a non-rectangular wave, almost equal to that of the lamp current Ipc, which is a rectangular wave, in each of the periods Ta and Tc as shown in FIG. 16. By making the average values almost equal, a change in the amount of light of the discharge lamp 500 caused by switching of a driving waveform is suppressed.

E. Modifications of Driving Waveform

Although the waveform obtained by superimposing a lamp wave on a rectangular wave is used as a driving waveform in the fourth example, various driving waveforms different from that shown in FIG. 16 may be used as waveforms in which the lamp current Ipv changes in the anode period Ta or the cathode period Tc. FIGS. 17 to 21 illustrate examples of a driving waveform that can be used instead of the driving waveform in the fourth example shown in FIG. 16.

Figure 17:
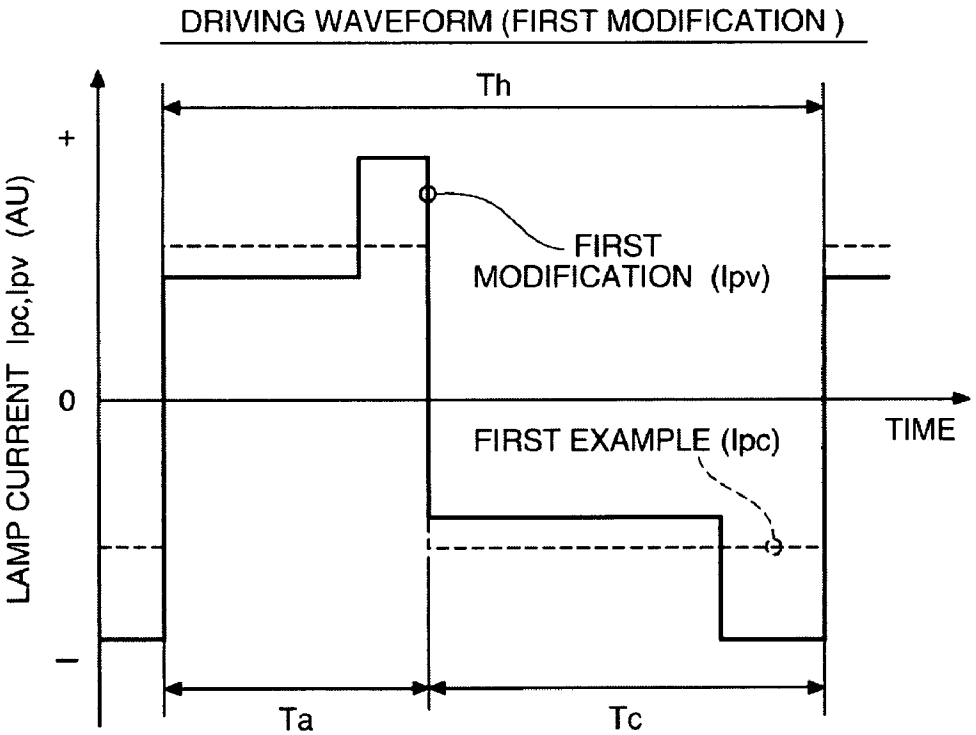
FIG. 17 is an explanatory view illustrating a first modification of a driving waveform.
Figure 18:
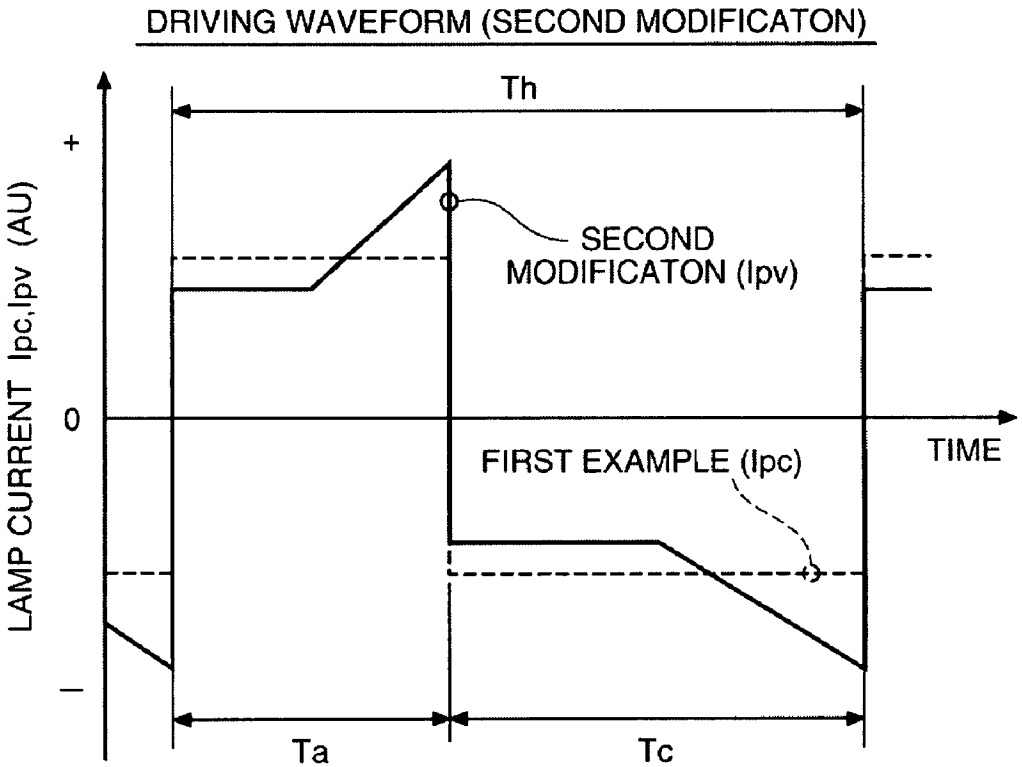
FIG. 18 is an explanatory view illustrating a second modification of a driving waveform.
Figure 19:
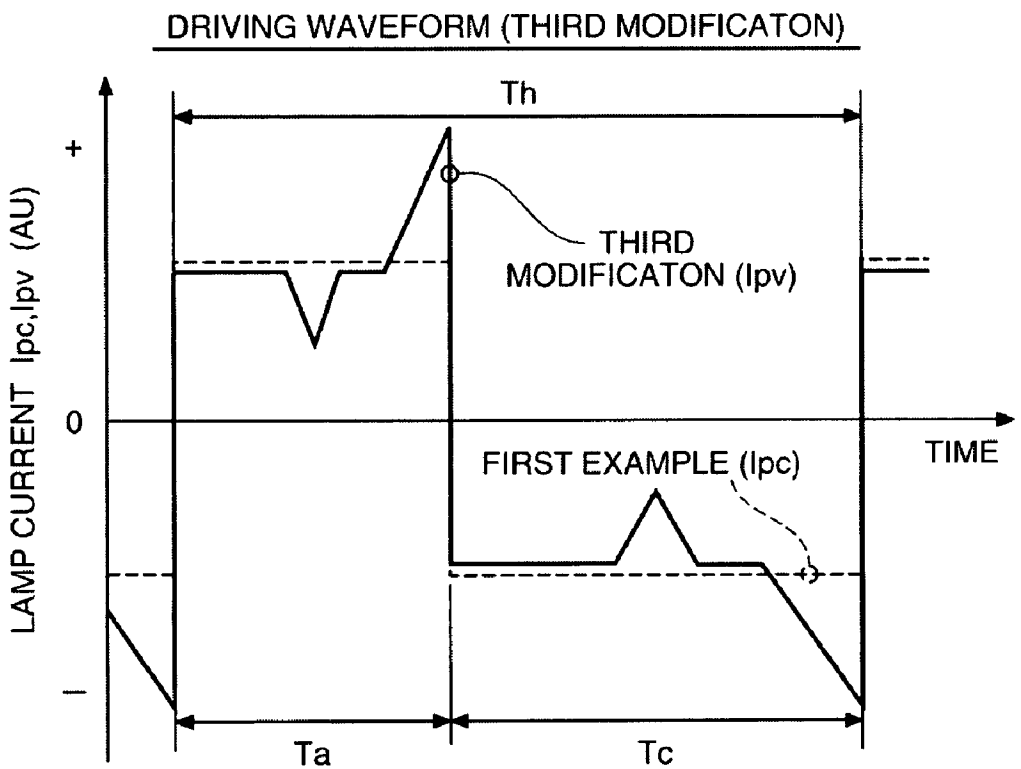
FIG. 19 is an explanatory view illustrating a third modification of a driving waveform.
Figure 20:
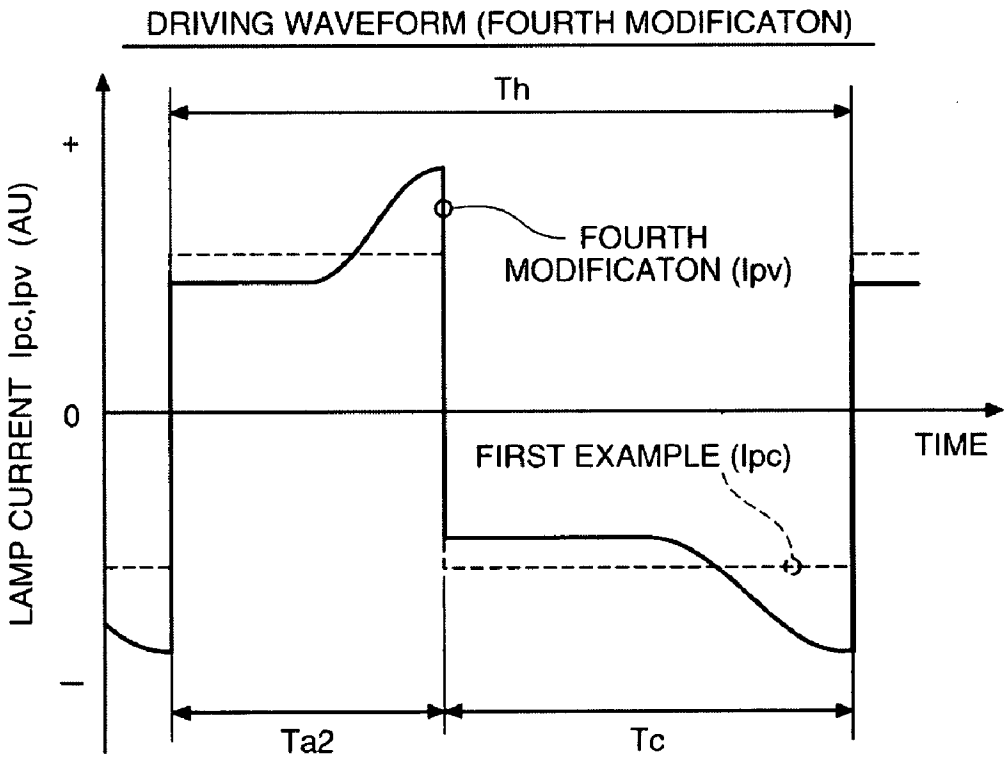
FIG. 20 is an explanatory view illustrating a fourth modification of a driving waveform.
Figure 21:
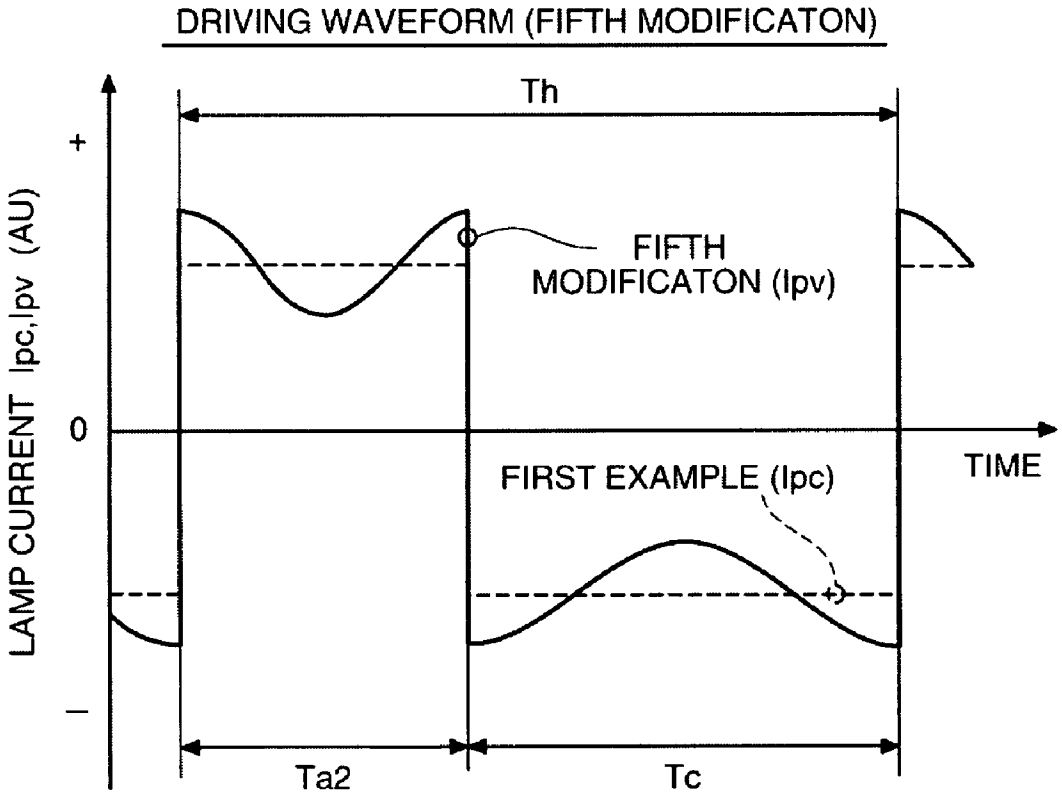
FIG. 21 is an explanatory view illustrating a fifth modification of a driving waveform.

A first modification of a driving waveform shown in FIG. 17 is a waveform obtained by superimposing a rectangular wave on a rectangular wave in periods corresponding to ¼ of the periods Ta and Tc from the rear ends. A second modification of a driving waveform shown in FIG. 18 is a waveform obtained by superimposing a lamp wave on a rectangular wave in second halves of the periods Ta and Tc. A third modification of a driving waveform shown in FIG. 19 is a waveform obtained by superimposing a lamp wave on a rectangular wave in periods corresponding to ¼ of the periods Ta and Tc from the rear ends and superimposing a triangular wave, which has valleys at positions corresponding to ½ of the periods Ta and Tc, on the rectangular wave. A fourth modification of a driving waveform shown in FIG. 20 is a waveform obtained by superimposing a sinusoidal wave corresponding to a ½ period on a rectangular wave in second halves of the periods Ta and Tc. A fifth modification of a driving waveform shown in FIG. 21 is a waveform obtained by superimposing a sinusoidal wave corresponding to one period on a rectangular wave in the entire periods Ta and Tc.

Thus, various waveforms may be used as driving waveforms. In general, it is possible to use any waveform in which an absolute value of the lamp current Ipv at the rear ends of the periods Ta and Tc is larger than that of an average lamp current (that is, the lamp current Ipc) of the periods Ta and Tc.

F. Modifications

In addition, the invention is not limited to the above-described examples or embodiments, but various modifications may be made within the scope without departing from the subject matter or spirit of the invention. For example, the following modifications may also be made.

F1. First Modification

A deterioration state of the discharge lamp 500 is detected using the lamp voltage in the second and third examples. However, the deterioration state of the discharge lamp 500 may also be detected in other methods. For example, the deterioration state of the discharge lamp 500 may be detected on the basis of occurrence of the arc jump caused by flattening of the projections 538 and 548 (FIGS. 7A to 7C). Alternatively, the deterioration state of the discharge lamp 500 may be detected on the basis of a decrease in the amount of light caused by deposition of an electrode material on the inner wall of the discharge space 512 (FIG. 2). The occurrence of arc jump or the decrease in the amount of light may be detected using an optical sensor, such as a photodiode, disposed adjacent to the discharge lamp 500.

F2. Second Modification

In the second and third examples, the lamp voltage, that is, the deterioration state of the discharge lamp 500 is detected and the maximum value of the driving frequency f is increased on the basis of the detection result as shown in FIG. 9. However, the maximum value of the driving frequency f may also be increased on the basis of other conditions. For example, the maximum value of the driving frequency f may be increased when the cumulative lighting time of the discharge lamp 500 measured by the timer 640 exceeds a predetermined reference time (for example, 500 hours). In this manner, an excessive decrease in the lamp voltage can be suppressed for the discharge lamp 500 in which the discharge electrode has not deteriorated yet, and extension of a projection can be accelerated for the discharge lamp 500 in which the discharge electrode has deteriorated. As a result, it becomes possible to use the discharge lamp 500 over a longer period of time. In this case, the predetermined reference time may be suitably set on the basis of the life of the discharge lamp 500, an experiment on the progress of deterioration of the discharge electrode, and the like.

F3. Third Modification

In the above examples, the liquid crystal light valves 330R, 330G, and 330B are used as light modulating units in the projector 1000 (FIG. 1). However, other arbitrary modulating units, such as a DMD (digital micromirror device; trademark of Texas Instruments, Inc.), may also be used as the light modulating units. In addition, the invention may also be applied to various kinds of image display devices including a liquid crystal display device, exposure devices, or illuminating devices as long as these devices use discharge lamps as light sources.

The entire disclosure of Japanese Patent Application No. 2008-067109, filed Mar. 17, 2008 is expressly incorporated by reference herein.

What is claimed is:

1. A driving method for a discharge lamp that lights by performing discharge between two electrodes while alternately switching a polarity of a voltage applied between the two electrodes so that an alternating current is supplied to the discharge lamp, the method comprising steps of:

modulating an anode duty ratio of the alternating current applied to the discharge lamp, which is a ratio of an anode time for which one of the electrodes operates as an anode in one cycle of the polarity switching, by setting first and second periods with different anode duty ratios; and setting a first polarity switching period in the first period to be shorter than a second polarity switching period in the second period.

2. The driving method for a discharge lamp according to claim 1, wherein the anode duty ratio in the first period is higher than that in the second period.

3. The driving method for a discharge lamp according to claim 2, wherein a third period with an anode duty ratio higher than that in the first period is set when modulating the anode duty ratio, and a polarity switching period in the third period is set longer than the first polarity switching period.

4. The driving method for a discharge lamp according to claim 1, wherein the first polarity switching period when a predetermined condition is satisfied is set shorter than the first polarity switching period when the predetermined condition is not satisfied.

5. The driving method for a discharge lamp according to claim 4, wherein the second polarity switching period when the predetermined condition is satisfied is set longer than the second polarity switching period when the predetermined condition is not satisfied.

6. The driving method for a discharge lamp according to claim 4, wherein the predetermined condition is satisfied when a cumulative lighting time of the discharge lamp exceeds a predetermined reference time.

7. The driving method for a discharge lamp according to claim 4, further comprising steps of:

detecting a deterioration state of the electrode according to the use of the discharge lamp; and determining whether or not the predetermined condition is satisfied on the basis of the deterioration state.

8. The driving method for a discharge lamp according to claim 7, wherein the deterioration state is detected on the basis of a voltage applied between the two electrodes in supplying predetermined power between the two electrodes.

9. The driving method for a discharge lamp according to claim 1, wherein an absolute value of a discharge current supplied to the discharge lamp at a rear end of a same polarity period for which the polarity is uniformly maintained is set larger than an absolute value of an average discharge current in the same polarity period.

10. The driving method for a discharge lamp according to claim 1, wherein the discharge lamp has a condition in which an operating temperature of one of the two electrodes is higher than that of the other electrode, and an anode duty ratio in the one electrode is set to be lower than that in the other electrode.

11. The driving method for a discharge lamp according to claim 10, wherein the discharge lamp has a reflecting mirror that reflects light emitted between the electrodes toward the other electrode side.

12. A driving device for a discharge lamp, comprising:

a discharge lamp lighting unit that makes the discharge lamp light by supplying the power between two electrodes of the discharge lamp, the discharge lamp lighting unit including a polarity switching unit that alternately switches a polarity of a voltage applied between the electrodes so that an alternating current is supplied to the discharge lamp; and a power supply control unit that controls a power supply state of the discharge lamp lighting unit, the power supply control unit including:

an anode duty ratio modulating unit that modulates an anode duty ratio of the alternating current applied to the discharge lamp, which is a ratio of an anode time for which one of the electrodes operates as an anode in one period of the polarity switching, by setting first and second periods with different anode duty ratios; and a switching period modulating unit that sets a first polarity switching period in the first period to be shorter than a second polarity switching period in the second period.

13. A light source device, comprising:

a discharge lamp;

a discharge lamp lighting unit that makes the discharge lamp light by supplying the power between two electrodes of the discharge lamp, the discharge lamp lighting unit including a polarity switching unit that alternately switches a polarity of a voltage applied between the electrodes so that an alternating current is supplied to the discharge lamp; and a power supply control unit that controls a power supply state of the discharge lamp lighting unit, the power supply control unit including:

an anode duty ratio modulating unit that modulates an anode duty ratio of the alternating current applied to the discharge lamp, which is a ratio of an anode time for which one of the electrodes operates as an anode in one period of the polarity switching, by setting first and second periods with different anode duty ratios; and a switching period modulating unit that sets a first polarity switching period in the first period to be shorter than a second polarity switching period in the second period.

14. An image display device, comprising:

a discharge lamp that is a light source for image display;

a discharge lamp lighting unit that makes the discharge lamp light by supplying the power between two electrodes of the discharge lamp, the discharge lamp lighting unit including a polarity switching unit that alternately switches a polarity of a voltage applied between the electrodes so that an alternating current is supplied to the discharge lamp; and a power supply control unit that controls a power supply state of the discharge lamp lighting unit, the power supply control unit including:

an anode duty ratio modulating unit that modulates an anode duty ratio of the alternating current applied to the discharge lamp, which is a ratio of an anode time for which one of the electrodes operates as an anode in one period of the polarity switching, by setting first and second periods with different anode duty ratios; and a switching period modulating unit that sets a first polarity switching period in the first period to be shorter than a second polarity switching period in the second period.

* * * * *